US007670407B2

(12) United States Patent
Pretorius

(10) Patent No.: US 7,670,407 B2
(45) Date of Patent: Mar. 2, 2010

(54) METHOD OF PRODUCING TITANIUM

(75) Inventor: Gerard Pretorius, Lyttelton (ZA)

(73) Assignee: Peruke (Proprietary) Limited, Johannesburg (ZA)

( * ) Notice: Subject to any disclaimer, the term of this patent is extended or adjusted under 35 U.S.C. 154(b) by 269 days.

(21) Appl. No.: 11/795,890

(22) PCT Filed: Dec. 14, 2005

(86) PCT No.: PCT/IB2005/054236

§ 371 (c)(1),
(2), (4) Date: Jul. 23, 2007

(87) PCT Pub. No.: WO2006/079887

PCT Pub. Date: Aug. 3, 2006

(65) Prior Publication Data

US 2008/0145687 A1 Jun. 19, 2008

(30) Foreign Application Priority Data

Jan. 27, 2005 (ZA) ..... 05/0819

(51) Int. Cl.
*C22B 3/44* (2006.01)
*C22B 34/12* (2006.01)

(52) U.S. Cl. ..... 75/739; 75/416; 423/82; 423/85; 423/472

(58) Field of Classification Search ..... 75/739, 75/416; 423/82, 85, 472
See application file for complete search history.

(56) References Cited

U.S. PATENT DOCUMENTS 2,568,341 A 9/1951 Kawecki et al. ..... 23/88

(Continued)

FOREIGN PATENT DOCUMENTS

EP 134643 A2 * 3/1985

(Continued)

OTHER PUBLICATIONS

Thermal Analysis of Complex Fluorides, P. Bukovec, N. Bukovec and A. Demsar, Journal of thermal Analysis, vol. 36 (1990) 1751-1760.

(Continued)

*Primary Examiner*—George Wyszomierski
*Assistant Examiner*—Tima M McGuthry-Banks
(74) *Attorney, Agent, or Firm*—Howrey LLP

(57) ABSTRACT

A method of producing titanium metal from a titanium-containing material includes the steps of producing a solution of $M''TiF_6$ from the titanium-containing material, selectively precipitating $M'_2TiF_6$ from the solution by the addition of (M')aXb and using the selectively precipitated $M'_2TiF_6$ to produce titanium. M" is a cation of the type which forms a hexafluorotitanate, M' is selected from ammonium and the alkali metal cations, X is an anion selected from halide, sulphate, nitrite, acetate and nitrate and a and b are 1 or 2.

20 Claims, 17 Drawing Sheets

U.S. PATENT DOCUMENTS

| | | | | |
|---|---|---|---|---|
| 2,823,991 | A | 2/1958 | Kamlet | 75/84.4 |
| 3,576,756 | A * | 4/1971 | Russo | 252/301.4 F |
| 3,839,020 | A | 10/1974 | Honma et al. | 75/84.5 |
| 4,437,888 | A | 3/1984 | Jecker | 75/84.4 |

FOREIGN PATENT DOCUMENTS

| | | | |
|---|---|---|---|
| GB | 2185248 | A | 12/1986 |
| JP | 05222625 | | 9/1993 |
| JP | 06230785 | | 8/1994 |
| WO | WO 94/05600 | | 3/1994 |
| WO | WO 9405600 | A1 * | 3/1994 |
| WO | WO 2006/079887 | | 8/2006 |

OTHER PUBLICATIONS

The Investigation of Thermal Decomposition of Ammonium Hexafluoro-scandate, -titanate, -vana-date, and -chromate, P. Bukovee and J. Siftar, Monatshefte fur Chemie 105, 510-516 (1974).

PCT International Search Report for International Patent Application No. IB2005/054236 (cited referenced listed above), mailed Jul. 27, 2006.

* cited by examiner

Titanium grade 4 (Fe content) : sodium sulphate precipitate, magnesium reduction flow diagram 3

METHOD OF PRODUCING TITANIUM

This application claims priority under 35 USC § 371 of International application number PCT/IB2005/054236, filed Dec. 14, 2005, which claims priority to South African application number 2005/0819, filed Jan. 27, 2005.

This invention relates to the production of titanium metal, titanium alloys and titanium compounds.

Titanium is usually commercially produced from titanium tetrachloride ($TiCl_4$) by the Hunter or Kroll processes. These processes involve a sodium or a magnesium reduction step. Titanium has also been produced by the reduction of potassium hexafluorotitanate ($K_2TiF_6$) with sodium, by the electrolytic reduction of titanium dioxide ($TiO_2$) and by the reduction of $TiO_2$ with magnesium or calcium. Titanium can accordingly be produced from a variety of titanium-containing precursors using a variety of reducing agents.

The density of titanium metal is about 45% of that of steel, however titanium is as strong as steel and has superior chemical resistance. Titanium is also the ninth most abundant element in the Earth's crust, but despite its abundance and superior properties, the world market for titanium is only 1% of the aluminium market and only 0.1% of the stainless steel market. The reason for this is its price. Only limited markets such as the military, aerospace and medical markets can afford to use titanium. The main reasons why titanium metal is so expensive are because the precursors used in the production of titanium are expensive and because of high losses due to oxidation during the melting, casting and forging of the metal.

The present invention provides an efficient and inexpensive process for the production of titanium, its alloys and its compounds.

According to a first aspect of the invention, there is provided a method of producing titanium metal from a titanium-containing material, the method including the steps of producing a solution of $M^{II}TiF_6$ from the titanium-containing material, selectively precipitating $M^I{}_2TiF_6$ from the solution by the addition of $(M^I)aXb$ in which $M^{II}$ is a cation of the type which forms a hexafluorotitanate, $M^I$ is selected from ammonium and the alkali metal cations, X is an anion selected from halide, sulphate, nitrite, acetate and nitrate, and a and b are 1 or 2; and using the selectively precipitated $M^I{}_2TiF_6$ to produce titanium.

In the case of nitrate, $M^{II}$ will be in its highest oxidation state.

$M^{II}$ may be selected from $Fe^{2+}$, $Mn^{2+}$, $Zn^{2+}$, $Mg^{2+}$, $Cu^{2+}$, $Ca^{2+}$, $Sr^{2+}$, $Ba^{2+}$, $Co^{2+}$ and $Ni^{2+}$.

The alkali metal may be selected from lithium, sodium and potassium. Preferably, $M^{II}TiF_6$ will be $FeTiF_6$ and $(M^I)aXb$ will be $NH_4Cl$.

The titanium-containing material may be selected from ilmenite, rutile, anatase, perovskite, brookite, pseudo-brookite, sphene, leucoxene and titaniferous slags. Ilmenite is $FeTiO_3$. Rutile, anatase, brookite and leucoxene are all naturally occurring $TiO_2$-containing minerals. Titaniferous slag is a $TiO_2$-containing material produced largely from the smelting of ilmenite. Sphene is $CaTiSiO_5$ and perovskite is $CaTiO_3$.

When ores other than ilmenite or perovskite are used the ratio $Ti:M^{II}$ will be adapted to be 1:1 or higher so that the molar amount of $M^{II}$ is at least equal to that of the Ti or higher. This can be achieved by either the addition of Ti or by the addition of $M^{II}$.

The $M^{II}TiF_6$ may thus be $FeTiF_6$ and the solution of $FeTiF_6$ may be produced by the digestion of ilmenite with aqueous HF.

The ilmenite may be used in excess. The concentration of the HF may be between about 5 and 60%. Preferably, it will be between about 20 and 24%.

The method may include the step of adding a reducing agent to the solution produced in the digestion step to reduce at least some of any Fe (III) present in the solution to Fe(II). The reducing agent may be a metal reducing agent. The metal may be selected from Fe, for example in the form of iron filings or steel wool, Al, Zn, Cu, Mn and Mg.

The method may include adding the $(M^I)aXb$ in the solid state to the solution produced in the digestion step.

The method may include the further step of purifying the $M^{II}TiF_6$ by recrystallisation.

When the $M^I{}_2TiF_6$ is $(NH_4)_2TiF_6$, the method may include dissolving the $(NH_4)_2TiF_6$ in water to produce a solution and precipitating $Li_2TiF_6$, $Na_2TiF_6$ or $K_2TiF_6$ by the addition of a lithium, sodium or potassium salt to the solution. The salt may be selected from alkali metal chlorides and sulphates but, naturally, any other suitable alkali metal salt may be used. Preferably the salt will be sodium chloride or sodium sulphate.

The method may then include the step of reducing the $Li_2TiF_6$, $Na_2TiF_6$ or $K_2TiF_6$ to produce titanium. This route is referred to below as Option A. The reduction may be carried out with a reducing agent selected from sodium, magnesium, potassium and calcium. In this case the method may include, prior to the reduction step, the step of mixing the $Na_2TiF_6$ with a predetermined quantity of at least one other metal salt so that the titanium produced in the reduction step is in the form of a titanium alloy containing at least one other metal. The other metal salt may, for example be $Na_3AlF_6$ or $Na_2VF_7$ or a combination thereof so that the titanium alloy produced contains aluminium or vanadium or both.

The method may include, for example, adding sufficient $Na_3AlF_6$ and $Na_2VF_7$ to produce grade 5 titanium (which contains about 6% aluminium and about 4% vanadium). Naturally other metal fluoride salts such as $AlF_3$, $VF_5$, $VF_4$ or $VF_3$ could be used and the amount varied so that a variety of alloys can be prepared.

Where the titanium-containing material is a $TiO_2$-containing material such as rutile, anatase, brookite, leucoxene or titaniferous slag in which $M^{II}$ is low, the method may include the steps of first forming an aqueous HF solution of the $M^{II}$ salt and then digesting the titanium-containing material in the acidic solution of the $M^{II}$ salt to produce the solution of $M^{II}TiF_6$.

In the preferred route, the method may include the step of reducing the $(NH_4)_2TiF_6$, in which the titanium is in the oxidation state IV, to produce a titanium-III product, decomposing the titanium-III product to produce $TiF_3$ and reducing the $TiF_3$ to titanium. This route is referred to below as Option B.

The $(NH_4)_2TiF_6$ may be reduced to the Ti(III) product with a reducing agent selected from aluminium, manganese, zinc, iron and magnesium. Instead, the $(NH_4)_2TiF_6$ may be electrolytically reduced to produce the Ti(III) product.

The Ti(III) product, for example, may be $(NH_4)_3TiF_6$, $(NH_4)_2TiF_5$, or $NH_4TiF_4$. All of these compounds decompose between about 400 and 700° C. to produce $TiF_3$.

The $TiF_3$ may be reduced to titanium by reduction with a reducing agent selected from sodium, magnesium and aluminium.

The invention extends to $TiF_3$ produced by the pyrolytic decomposition of $NH_4TiF_4$. The invention extends, further, to $TiF_3$ having an x-ray diffraction pattern as set out in FIG. 6.

The invention extends further to a method of producing titanium metal from a $TiO_2$-containing material, the method including the steps of preparing an aqueous hydrofluoric acid solution containing $M^{II}$, digesting the $TiO_2$-containing material in the solution to produce a solution containing $M^{II}TiF_6$, selectively precipitating $M^I{}_2TiF_6$ from the solution by the addition of $(M^I)aXb$ in which $M^{II}$ is a cation of the type which forms a hexafluorotitanate, $M^I$ is selected from ammonium and the alkali metal cations, X is an anion selected from halide, sulphate, nitrite, acetate and nitrate, and a and b are 1 or 2; and using the selectively precipitated $M^I{}_2TiF_6$ to produce titanium.

The $TiO_2$-containing material may be selected from rutile, anatase, brookite, leucoxene and titaniferous slag. However, any other suitable $TiO_2$-containing material may be used.

The aqueous hydrofluoric acid solution containing $M^{II}$ may be prepared by dissolving a basic salt of $M^{II}$ in aqueous HF. The basic salt may for example be the oxide, hydroxide or carbonate of $M^{II}$.

In a preferred embodiment, $M^I$ will be $NH_4^+$ and the method will include reducing the optionally purified $(NH_4)_2TiF_6$ to $NH_4TiF_4$;

pyrolizing the $NH_4TiF_4$ to produce $TiF_3$; and reducing the $TiF_3$ to titanium metal.

According to a further aspect of the invention, there is provided a method of forming a metal alloy, the method including the steps of combining a predetermined amount of a reducible fluoride salt of a first metal with a predetermined amount of at least one reducible salt of another metal to produce a salt mixture and reducing the fluoride salt mixture to produce a mixture of the metals or an alloy.

The method may include combining the fluoride salt of the first metal with two or more reducible salts of other metals so that an alloy containing three or more metals is produced.

The reducible fluoride salt of the first metal may be a reducible salt of titanium. The reducible salt of the other metal may be a reducible salt of metals selected from vanadium, aluminium, palladium, molybdenum and nickel.

The reducible salt of the first metal may, in particular, be $M_2TiF_6$ and the reducible salt of the other metal may be selected from $M_3AlF_6$, $M_2VF_7$ and combinations thereof in which M is an alkali metal. In particular, M may be sodium.

The method may include the further step of smelting the mixture to produce the alloy.

According to another aspect of the invention there is provided a salt which is $NH_4TiF_4$.

The invention extends to $NH_4TiF_4$ having an x-ray diffraction pattern as set out in FIG. 5.

According to another aspect of the invention, there is provided a method of making $NH_4TiF_4$, the method including the step of reducing $(NH_4)_2TiF_6$.

The reducing agent may be a metal reducing agent. It may, for example, be aluminium, an aluminium amalgamate, mercury coated aluminium eg Al(Hg) or aluminium carbide.

According to another aspect of the invention, there is provided a method of making titanium metal powder, the method including the step of reducing $TiF_3$ with aluminium to produce a reduction product comprising titanium metal powder and $AlF_3$.

The method may include the further step of heating the reduction product to a temperature and for a time which are sufficient to sublime off most of the $AlF_3$ but to cause retention of sufficient $AlF_3$ on the surface to reduce the reactivity of the titanium metal powder.

The method may include heating the reduction product until the $AlF_3$ on the surface of the titanium metal powder comprises between about 0.005 and 40% of the mass of the material, preferably between about 0.05 and 10% and more preferably between about 0.1 and 5.0%.

The residual $AlF_3$ causes an inert layer which is at least a monolayer thick to be formed on the surface of the titanium powder. This substantially increases the temperature at which spontaneous combustion of the titanium powder takes place in air from about 250° C. to above 600° C. The powder is accordingly safer to use and transport than prior art titanium powders.

The invention extends to a deactivated titanium powder having a surface layer of $AlF_3$ in which the $AlF_3$ comprises between about 0.05 and 10% of the mass of the material and preferably between about 0.1 and 5% $AlF_3$.

The invention extends further to a method of making titanium metal powder the method including the steps of reducing $TiF_3$ with aluminium to produce a reduction product comprising titanium metal powder and $AlF_3$; and heating the reduction product to sublime off the $AlF_3$ to produce a titanium metal powder containing essentially no aluminium in metal or alloy form.

According to a further aspect of the invention, in a method of preparing a titanium artifact from a titanium metal precursor material, which includes the steps of subjecting the titanium metal precursor material to a heating step to produce a titanium metal intermediate material and subjecting the intermediate material to one or more process steps to produce the artifact, there is provided the improvement of conducting the heating step in an atmosphere containing a volatile fluoride salt.

The titanium metal intermediate material produced will thus have a protective layer of the fluoride salt.

The atmosphere will preferably be an inert atmosphere such as an argon or helium atmosphere. The titanium metal precursor material may be deactivated titanium powder as hereinbefore described.

The volatile fluoride salt may be selected from $AlF_3$, $MgF_2$ and NaF. Naturally, any other suitable fluoride salt may be used.

The heating step may be by firing or furnace heating using, for example, vacuum furnaces, inert gas furnaces, microwave assisted furnaces, radio frequency assisted furnaces, induction furnaces or zone refining furnaces.

The process steps may be standard process steps of the type used in the fabrication of titanium artifacts such as uniaxial pressing, cold isostatic pressing, hot isostatic pressing, cold rolling, hot rolling and the like. The process steps may include the addition of sacrificial binders such as waxes and polymers.

The titanium artifact may be a solid material or a porous material. It may be an alloy of titanium and may be selected from rods, bars, wires, sheets and the like.

The titanium artefact may contain trace quantities of fluoride. By trace quantities is meant quantities which do not affect the bulk properties of the titanium.

The furnace arrangement and heating cycle will be such that during the heating step the titanium is always surrounded by a protective atmosphere containing the fluoride salt so that it is protected from reaction with oxygen, nitrogen, carbon, hydrogen or the like.

According to a further aspect of the invention, there is provided a method of recovering titanium from ilmenite, the method including the steps of digesting ilmenite in aqueous HF to produce $FeTiF_6$ and removing insoluble material;

selectively precipitating $(NH_4)_2TiF_6$ by addition of an ammonium salt;

optionally purifying the precipitated $(NH_4)_2TiF_6$;

reducing the optionally purified $(NH_4)_2TiF_6$ to $NH_4TiF_4$ with mercury activated aluminium;

pyrolizing the $NH_4TiF_4$ to produce $TiF_3$; and reducing the $TiF_3$ to titanium metal.

According to a further aspect of the invention, there is a provided a method of recovering titanium from a $TiO_2$-containing material, the method including the steps of preparing an aqueous hydrofluoric acid solution containing $M^{II}$, digesting the $TiO_2$-containing material in the solution to produce a solution containing $M^{II}$ $TiF_6$ and removing insoluble material;

selectively precipitating $(NH_4)_2TiF_6$ by addition of an ammonium salt;

optionally purifying the precipitated $(NH_4)_2TiF_6$ reducing the optionally purified $(NH_4)_2TiF_6$ to $NH_4TiF_4$ with mercury activated aluminium;

pyrolizing the $NH_4TiF_4$ to produce $TiF_3$; and reducing the $TiF_3$ to titanium metal.

The $TiO_2$ containing material may be selected from anatase, rutile, brookite, leucoxene and titaniferous slag.

According to a further aspect of the invention, there is provided a method of making a titanium compound selected from titanium nitride, titanium carbide, titanium boride, titanium hydride, titanium silicide, titanium phosphide and titanium sulphide, the method including the step of heating a deactivated powder as hereinbefore described with a source of nitrogen, carbon, boron, hydrogen, silicon, phosphorous or sulphur.

The source of nitrogen, carbon, hydrogen, silicon or sulphur may be the corresponding elements, for example nitrogen and hydrogen as the gas, carbon as powder or coke, silicon as powdered silicon and sulphur as powdered sulphur.

The source of boron may be diborane. The source of phosphorous may be phosphine.

The titanium nitride may have an x-ray diffraction pattern as set out in FIG. 12.

DISCUSSION

Prior art methods for the digestion of ilmenite have made use of either sulphuric acid or chlorine and coke at high temperatures. It is also known that ilmenite can be digested in dilute HF in an exothermic reaction according to the equation:

$$FeTiO_3+6HF=FeTiF_6+3H_2O$$

The dilution of the HF was controlled at 20-24% so that a saturated solution of $FeTiF_6$, which could be filtered to remove insoluble material, was produced. It was found that the yield and purity of the $FeTiF_6$ precursor produced in the selective precipitation step could be improved if all of the iron in solution was in oxidation state II (ie if no $Fe^{3+}$ was present) and if no free HF was present. This was achieved by using an excess of ilmenite, which could then be recycled, and by the addition of metallic iron filings to the solution after digestion. The addition of iron filings reduced $Fe^{3+}$ to $Fe^{2+}$ according to the equation:

$$Fe^0+2Fe^{3+}=3Fe^{2+}$$

If too much iron was added, reduction of $Ti^{4+}$ to $Ti^{3+}$ occurred and this had a negative influence on the yield. It was found that copper filings could first be added to a small sample portion of the leachate to reduce the $Fe^{3+}$ to $Fe^{2+}$ without reducing the $Ti^{4+}$ and the correct amount of metallic iron could then be calculated.

The $(M^I)aXb$ was preferably added in the form of the dry salt. For example, if a saturated solution of $M^{II}TiF_6.6H_2O$, in which $M^{II}$ is $Fe^{2+}$ $Mn^{2+}$, $Zn^{2+}$, $Mg^{2+}$, $Cu^{2+}$ or the like is mixed with the dry salt of $M^ICl$, in which $M^I$ is $Li^+$, $Na^+$, $K^+$ or $NH_4^+$, the $M^I{}_2TiF_6$ intermediate precipitates almost quantitively from the solution while the $M^{II}Cl_2$, which is co-produced in the reaction, remains in solution. This is a not unexpected result in the case of $K_2TiF_6$ which has a low solubility, but such a near-quantitative precipitation in respect of $Li_2TiF_6$, and $(NH_4)_2TiF_6$, both of which are highly soluble in water, is particularly unexpected.

It was also found that, for the $(NH_4)_2TiF_6$ to precipitate quantitatively, 4 moles of $NH_4Cl$ had to be added to 1 mole of $M^{II}TiF_6$. This can be explained by the co-formation of the $(NH_4)_2M^{II}Cl_4$ double salts. This would also be expected in the case of potassium, however, because of its low solubility, $K_2TiF_6$ precipitates in preference to the formation of the $K_2M^{II}$-double salt. Consequently, only 2 moles of KCl or 1 mole of $K_2SO_4$ was needed to precipitate $K_2TiF_6$ almost quantitively. The same applied in respect of $Li^+$ and $Na^+$ which do not form double salts with $M^{II}$. Chloride was used in preference to $SO_4{}^{2-}$ because of its higher solubility and easier recycling loops. Other anions like $CH_3COO^-$, $NO^{2-}$, and the like can also be used for selective precipitation but $NO^{3-}$ is not suitable because it causes oxidation of $Fe^{2+}$ or $Mn^{2+}$.

The selective precipitation resulted in the removal of the bulk of the $M^{II}$ so that, after filtration and washing, only low levels of $M^{II}$ remained in the crystalline precipitate. In this way a relatively pure titanium precursor was obtained in high yield (>90%).

If the $M^I{}_2TiF_6$ was reduced directly, the iron level in the resulting titanium corresponded to that of grade 4 titanium (although the oxygen, nitrogen, carbon and hydrogen levels were very low). In order to reduce the iron content of the titanium to produce a metal having an iron level corresponding to that of grade 1 titanium or better, it was necessary to improve the purity of the precursors. Because of the low solubility of $K_2TiF_6$ and $Na_2TiF_6$, recrystallisation was not practical and these salts were purified by solvent extraction with methyl isobutyl ketone (MIBK) and HCl. It was more practical to selectively precipitate the highly soluble $Li_2TiF_6$ or $(NH_4)_2TiF_6$ salts as these could readily be recrystallised. Of the two salts, it was more economical to use $(NH_4)_2TiF_6$. It was also found that boiling saturated solutions of $(NH_4)_2TiF_6$ did not result in hydrolysis of the salt (which is unusual for water-soluble titanium salts) and a high concentration could accordingly be obtained so that a maximum yield of the crystalline product could be obtained on cooling. Very pure titanium precursors were obtained in this way and were pure enough to be used as precursors in the production of $TiO_2$ pigments. The titanium metal produced on reduction of the purified $(NH_4)_2TiF_6$ was purer than commercial grade 1 titanium.

After the $(NH_4)_2TiF_6$ has been purified by recrystallisation, two approaches can be followed to produce titanium metal.

The first approach (Option A) involves the reduction of $Na_2TiF_6$ or $K_2TiF_6$ produced from the $(NH_4)_2TiF_6$.

Because of the difference in solubility between $(NH_4)_2TiF_6$ and $Na_2TiF_6$ (or the corresponding potassium salt), $Na_2TiF_6$ can be precipitated from a saturated solution of $(NH_4)_2TiF_6$ by the addition of sodium chloride. The $NH_4Cl$ produced as a byproduct can then be filtered from the precipitate and crystallised for re-use in the selective precipitation step.

After drying, the $Na_2TiF_6$ (mp. 700° C.) can be reduced under an argon atmosphere. Reduction is exothermic at the melting point of the salt. Sodium or magnesium (10% stoichometric excess) is usually used as the reducing agent but potassium or calcium can also be used.

After reduction, the excess sodium or magnesium is boiled off at 900° C. or 1100° C. respectively. The respective products are 6NaF(Ti) or $2NaMgF_3$(Ti).

The fluoride-titanium mixture is then fed into a vertically arranged elongate tubular zirconia or molybdenum crucible under an argon atmosphere. The top of the crucible is heated to 1300° C. and the bottom to 1700° C. The bulk of the molten 6NaF (mp. 990° C.) or $2NaMgF_3$ (mp. 1030° C.) is tapped from the crucible above the molten titanium and the remainder of the molten fluoride acts as a blanket on top of the molten titanium (mp 1670° C.) to protect it from oxygen and nitrogen.

The molten titanium is then cast into ingots or other products in a molten fluoride eutectic consisting, for example, of 40 mole % NaF and 60 mole % LiF (mp. 652° C.), to allow for the titanium to anneal at 700° C. In this way the titanium is still protected against oxidation and nitrification during the annealing process.

The second approach to the production of titanium (Option B) involves the pre-reduction of $(NH_4)_2TiF_6$ to a $Ti^{3+}$ species, conversion of the $Ti^{3+}$ species to $TiF_3$ and reduction of the $TiF_3$ to titanium metal.

For example, the $(NH_4)_2TiF_6$ produced in the selective precipitation step can be reduced with Al (Hg-activated) or with Mn without the addition of an acid. Typical products of the reduction are $NH_4TiF_4$ and $(NH_4)_3AlF_6$ or $(NH_4)_2TiF_5$ and $MnF_2$. In the case of reduction with aluminium, the $(NH_4)_3AlF_6$ is more soluble and can be removed from the almost insoluble $NH_4TiF_4$ precipitate by acid filtration. The latter can then be decomposed at 700° C. to produce $NH_4F$ (g) and $TiF_3$ (s). From the diluted $(NH_4)_3AlF_6$, $Na_3AlF_6$ (cryolite) can be precipitated as a by-product with NaCl and the resulting ammonium salt can be recycled.

With the addition of acid (usually HF), other reducing agents such as Zn, Al, Mn, Fe or Mg can be used. A typical product is $(NH_4)_2HTiF_6$ which is freely soluble in acid (pH 1-2) while the reducing agent-fluorides are much less soluble and can be separated from the $(NH_4)_2HTiF_6$ by filtration. Raising the pH with $NH_4OH$ (pH 6) precipitates $(NH_4)_3TiF_6$. After filtration and drying, the product can be decomposed at 700° C. to produce $3NH_4F$(g) and $TiF_3$ (s).

However, an alternative option is to reduce $(NH_4)_2TiF_6$ electrolytically. A membrane such as a canvas membrane is used to separate the anode from the cathode. Normally a lead anode and a graphite cathode are used. The anode side is filled with 0.1 N HF solution and the cathode side is filled with a saturated $(NH_4)_2TiF_6$ solution, acidified with HF to pH 1. The electrolytic reactions are as follows:

$$\text{Anode: } H_2O = \tfrac{1}{2}O_2(g) + 2H+(aq) + 2e^-$$

$$\text{Cathode: } 2Ti^{4+}(aq) + 2e^- = 2Ti^{3+}(aq)$$

After electrolysis, the pH of the violet $(NH_4)_2HTiF_6$ solution is increased by addition of $NH_4OH$ to pH 6 to precipitate $(NH_4)_3TiF_6$. After filtration and drying, the product can be decomposed at 700° C. to produce $3NH_4F$ (g) and $TiF_3$ (s). The $Ti^{3+}$ is then reduced to titanium metal.

$TiF_3$ can be reduced with Na, Mg or Al to produce 3NaF (Ti), $1\tfrac{1}{2}MgF_2$(Ti) or $AlF_3$(Ti) respectively. The reduction of $TiF_3$ is less exothermic than the reduction of $(Na,K)_2TiF_6$ and occurs above 700° C.

As described above, the NaF or $MgF_2$ can be melted from the titanium while $AlF_3$ will sublime at 1300° C.

To ensure that there is no free HF present after the digestion step, a 30±10% excess ilmenite is maintained during digestion. Because of its coarseness and high density, the excess ilmenite settles out from the leachate and the light insoluble precipitate after digestion. The digested suspension is pumped off from the settled ilmenite and filtered. The filter cake is then re-slurried and screened through a 45 μm screen. The top fraction (ilmenite) is recycled back into the digestion tank while the bottom fraction (mostly acid insolubles) is waste. In this way a digestion efficiency of greater than 90% is achieved.

In the Option A process which proceeds via the reduction of $Na_2TiF_6$, the choice of the reducing agent determines the choice of the salt used for the selective precipitation. Sodium favours a chloride precipitate while magnesium favours a sulphate precipitate. The recycling loops are set out in FIGS. 16 and 17 which respectively show the production of high purity titanium and of grade 4 titanium.

In the Option B process, which proceeds via the intermediate reduction of $Ti^{4+}$ to $Ti^{3+}$, the recycling loops will be essentially the same as those for the Option A process as indicated in FIG. 1. If an electrolytic pre-reduction ($Ti^{4+}$ to $Ti^{3+}$) is not used, the fluoride salts of the reducing agents would be by-products. If aluminium is used in the secondary reduction step ($Ti^{3+}$ to Ti), the sublimed $AlF_3$ can be sold as a by-product or the fluoride values can be recovered by steam hydrolysis at 400° C. according to the following equation $$2AlF_3 + 3H_2O = Al_2O_3 + 6HF$$

$Al_2O_3$ will then be the by-product.

$Fe_2O_3$ is the major by-product of the process of the invention. If magnesium is used as the reducing agent and not regenerated, $Mg(OH)_2$ or $MgSO_4$ will also be by-products.

The invention is now described by way of example with reference to the following Examples, the Figures and Table 1, in which FIG. 1 is a general flow diagram of the invention;

and in which Table 1 shows the chemical composition, mechanical properties and physical properties of different grades of titanium.

Figure 1:
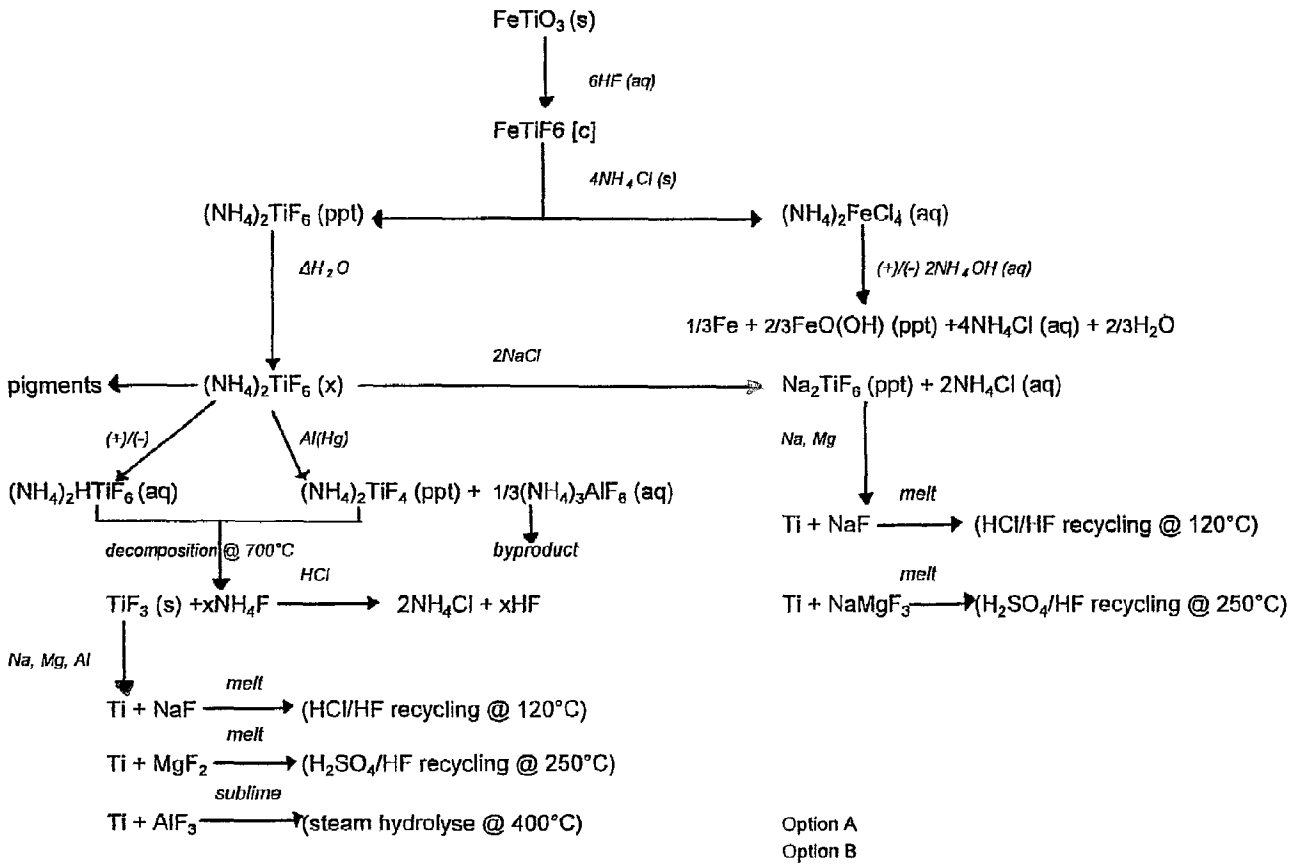
Figure 2:
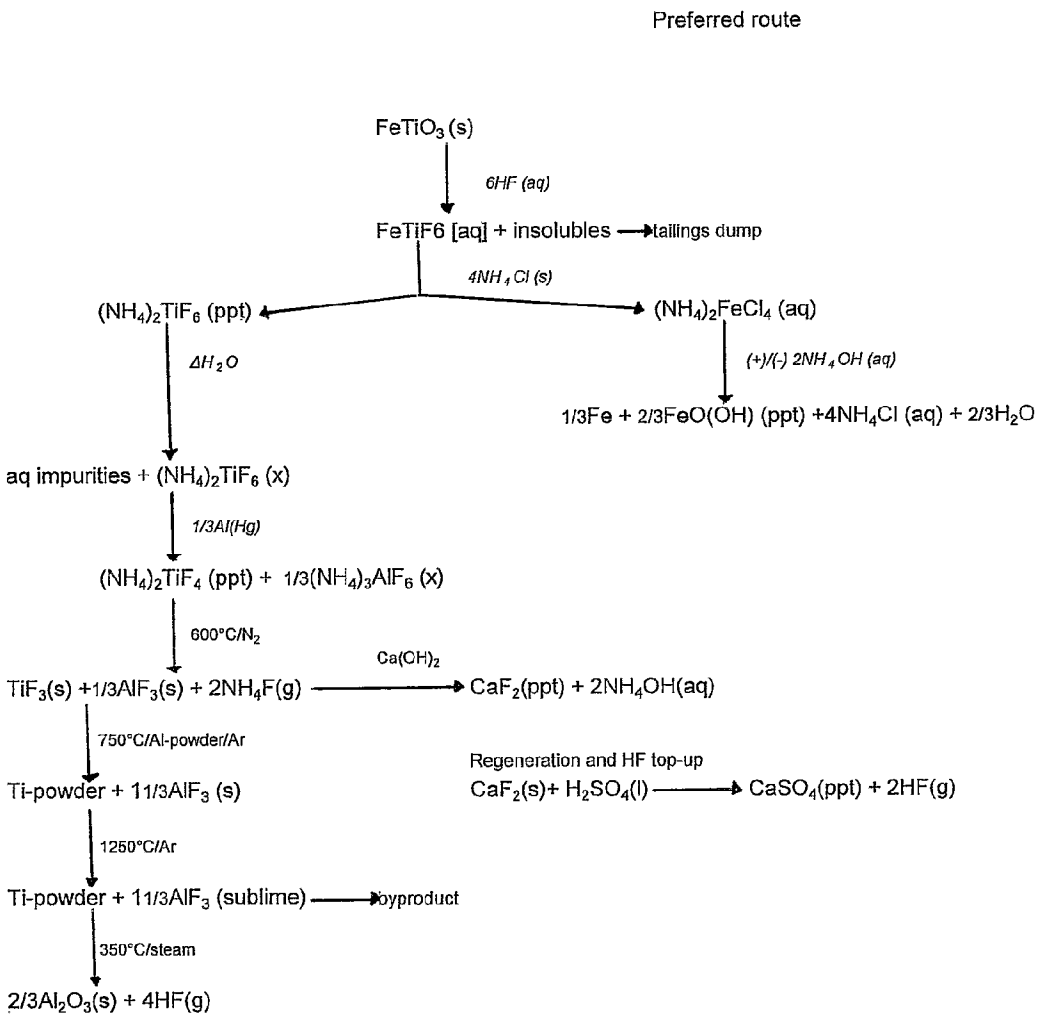
FIG. 2 is a flow diagram for the preferred route.

With reference to FIG. 1, the process of the invention can be divided into five stages. These are the digestion of ilmenite, the selective precipitation of the titanium precursor produced in the digestion step, the reduction of the precursor, the melting of the reduced titanium product into an ingot and the recycling of the reagents used in the process.

EXAMPLE 1

Production of Titanium from Ilmenite Via Al(Hg) Reduction of $(NH_4)_2TiF_6$ Step 1: Digestion of Ilmenite with Dilute HF Feed Material Ilmenite concentrate was used as the feed material for the digestion step. The material contained about 89.5% ilmenite, 6% hematite, 2.5% quartz and 2% other metal oxides. The particle size was uniform and approximately 98% of the material had a particle size of between +45 μm and −106 μm. The material typically had the following chemical composition:

| Al | Ca | Fe | Mg | Mn | Si | Ti | V |
|---|---|---|---|---|---|---|---|
| 0.35% | 0.1% | 37.2% | 0.27% | 0.95% | 1.18% | 28.3% | 0.5% |

Stoichiometry: HF Required for 500 g of Ilmenite Feed

The ilmenite used consisted of $FeTiO_3$ (89.5%), $Fe_2O_3$ (6.0%), $SiO_2$ (2.5%) and other material (2%). This corresponded to $FeTiO_3$ (447.5 g; 2.95 mol), $Fe_2O_3$ (30 g; 0.19 mol) and $SiO_2$ (12.5 g; 0.21 mol) in 500 g. The $FeTiO_3$, $Fe_2O_3$ and $SiO_2$ each require 6 mol of HF per mole for conversion, respectively, to $FeTiF_6$, $FeF_3$ and $H_2SiF_6$. The total amount of HF required was therefore (2.95+0.19+0.21)×6=20.1 mol for the 98% feedstock.

However, to ensure complete digestion, an excess of 20% ilmenite was used during digestion. After the digestion, approximately 94% of the excess ilmenite could be recovered because of its high density and coarse particle size.

Batches were prepared as follows. In a 2 l polypropylene beaker, ilmenite (600 g) was added to tap water (500 ml; 20° C.). While stirring vigorously, HF (900 ml; 40%) was added and a loose heavy plastic lid was placed on top of the beaker. The reaction was strongly exothermic and after about 10 minutes the suspension reached boiling point and boiled for about 5 minutes.

After 2 hours, Fe (12 g; steel wool) was added to the solution and the mixture was stirred for 1 hour to reduce all soluble Fe(III) to Fe(II).

The suspension was then filtered and washed with tap water (2×50 ml). Approximately 200 g of moist filter cake was obtained. This material was re-slurried to recover most of the excess ilmenite and a leachate of 1375 ml containing $FeTiF_6$ was obtained.

Extraction Efficiency

The Ti concentration in the leachate was approximately 100 g/t implying a Ti recovery of 137.5 g. The recovery efficiency was calculated as follows:

Stoichiometry: 141.5 g Ti (500 g feed)=97%

20% excess: 169.8 g Ti (600 g feed)=81%

94% recovery of excess: 144 g Ti (505 g feed)=95.5%

Step 2: Selective Precipitation of $(NH_4)_2TiF_6$

The leachate (1.375 l) contained Ti (137.5 g; 2.865 mol). This required $NH_4Cl$ (4×2.865=11.46 mol; 613.11 g).

$NH_4Cl$ (613 g) was slowly added to the $FeTiF_6$ leachate of step 1 (1375 ml) while stirring vigorously. The temperature dropped to below 10° C. and was raised to 15° C. using a warm bath. The suspension was then stirred for 1 hour at 15° C.

The resulting crystalline $(NH_4)_2TiF_6$ was filtered at 15-20° C., and pressed inside the filter head to remove as much excess liquid as possible. The vacuum was then broken and ice water (184 ml; 5° C.) was added to the product. The vacuum could be restored only after the water had penetrated the filter cake (approximately 2 minutes later) and the crystalline $(NH_4)_2TiF_6$ had the appearance of icing-sugar. The crystalline product was sucked and pressed as dry as possible.

Figure 3:
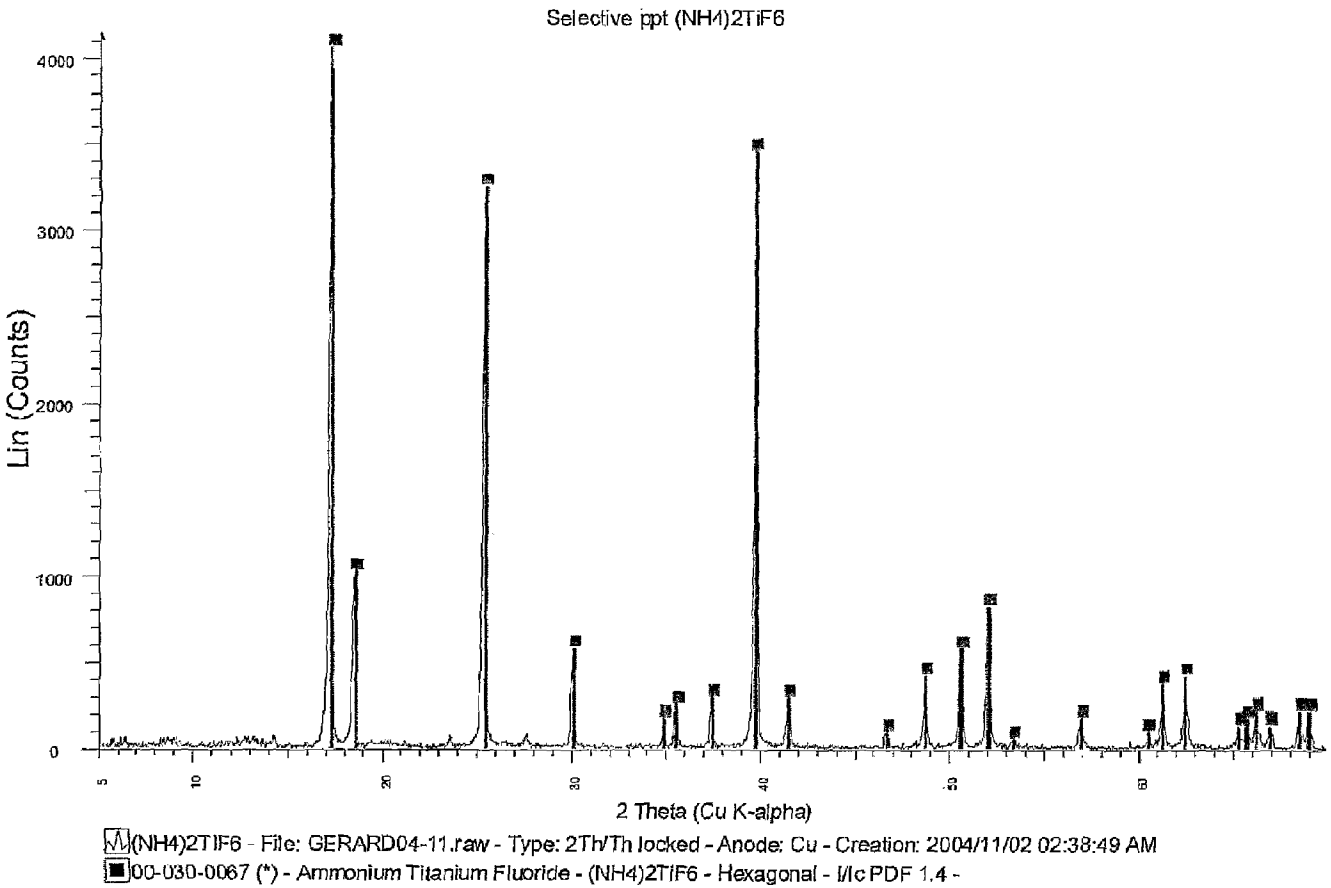
FIG. 3 is an x-ray diffraction pattern of selectively precipitated $(NH_4)_2TiF_6$.

The crystalline $(NH_4)_2TiF_6$ was then dried at 60° C. The yield was 522 g. The XRD of this product is shown in FIG. 3.

Precipitation Efficiency

Based on a $(NH_4)_2TiF_6$ crystalline product with a purity of 100% (522 g=2.631 mol Ti), the efficiency of Ti recovery was 92%. The Fe concentration in the crystalline product was typically about 0.5±0.4%. Other impurities such as Si and Al were also present. However, these impurities could be removed by prior treatment of the feed before digestion (for example by caustic leaching) or by precipitation of these elements after digestion. For example, after Fe reduction, NaCl could be added to precipitate $Na_2SiF_6$ and $Na_3AlF_6$.

Recrystallisation of $(NH_4)_2TiF_6$ $(NH_4)_2TiF_6$ (400 g), produced as described above and dried at 60° C., was added to water (500 ml) in a 2 liter vessel. It was found that anhydrous $(NH_4)_2TiF_6$ has a greater solubility than hydrated or moist $(NH_4)_2TiF_6.xH_2O$ A small piece of Al strip (approx 100 mm×25 mm) was added to the suspension.

While stirring, HF (0.5 ml; 40%) was added to the suspension to prevent hydrolysis and to initiate the reduction of a small amount of Ti(IV) with Al. The suspension was heated to boiling point (approx 100° C.). Any foam which formed on top of the solution decreased with time and was mixed into the solution.

The colour of the solution changed to light violet, indicating the presence of Ti(III). This also indicated that all of the iron present was in the form of Fe(II). When the solution boiled, a layer of violet $TiF_3$ poisoned the Al strip and the reduction stopped. The formation of a small amount of $(NH_4)_3AlF_6$ arising from the addition of the aluminium strip did not present a problem as this product is produced as a by product in the following step (Step 3). After the solution had boiled for about 1 minute, it was removed from the heat source and allowed to cool. The Al strip could then be removed and reused (without cleaning) in the next run.

The vessel was cooled to about 40° C. with cold water, and ice and cold water were then used to cool the vessel to 10° C. while stirring the resulting crystalline $(NH_4)_2TiF_6$.

The crystalline product was filtered and pressed inside the filter head to remove as much excess liquid as possible. The vacuum was then broken and ice water (50 ml; 5° C.) was added to the crystalline product. The vacuum could be restored only after the water had penetrated the filter cake (approximately 2 minutes later) and the crystalline product had the appearance of icing-sugar. The crystalline product was then sucked and pressed as dry as possible.

Figure 4:
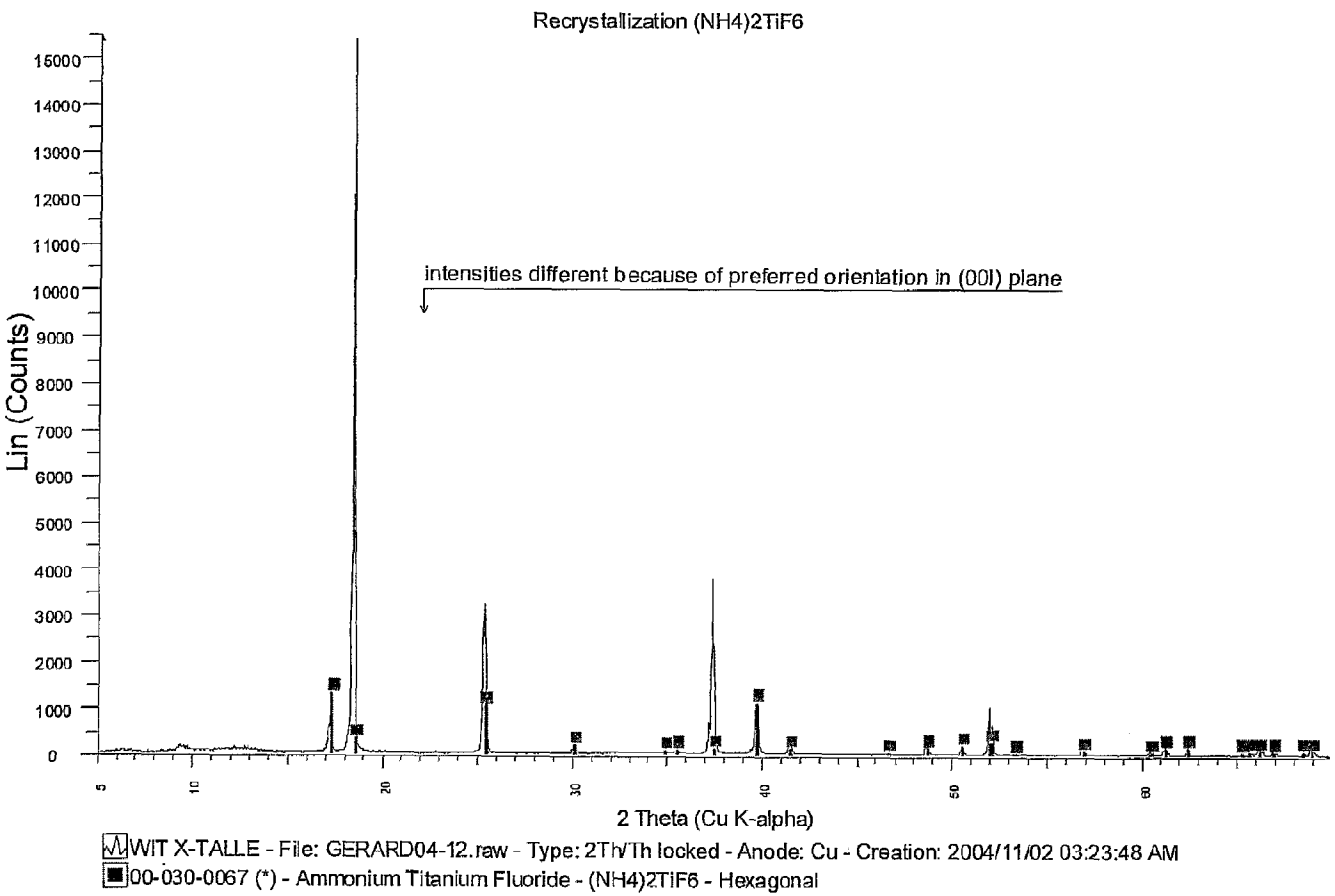
FIG. 4 is an x-ray diffraction pattern of the $(NH_4)_2TiF_6$ of FIG. 3 after recrystallisation.

The resulting crystalline $(NH_4)_2TiF_6$ was dried at 60° C. The yield was typically about 70% of the feed crystalline product without evaporation of additional water. The XRD of this product is shown in FIG. 4.

A crude but reliable way to test the purity of the dried crystalline $(NH_4)_2TiF_6$ was to add the product (approx 5 g) to CP grade HCl (appox 25 ml; 32%) in a 50 ml glass beaker. After standing for about 5 minutes, the HCl turned yellow or orange if any iron was present. Concentrated HCl is very sensitive to iron and the intensity of the yellow or orange colour was directly proportional to the iron concentration at concentration levels between about 1% and 0.01% Fe. This test was carried out on the feed crystalline product, recrystallised product and $(NH_4)_2TiF_6$ standard.

Step 3: Reduction of $(NH_4)_2TiF_6$ with Al(Hg)

Activation of Al with Hg

Aluminium buttons (ID approximately 10-15 mm, 1-3 mm thick, 150 g) were covered with a 1N NaOH solution in a 500 ml plastic beaker and Hg (approximately 50 ml) was added. The buttons were mixed using a plastic stirrer and dipped into the Hg. After about 5 minutes, the buttons were completely coated with Hg.

The sodium hydroxide was removed by rinsing the buttons with a strong flow of tap water inside the beaker for about 1 minute.

The excess Hg was then poured from the Hg-coated buttons through a 500 μm screen and the buttons were immediately covered with acetone. After about 1-2 hours in acetone, further free Hg dropped from the buttons, leaving only a micro layer of Hg on the buttons.

When ready to use, the Al(Hg)-buttons were screened (500 μm) from the acetone and free Hg, and immediately dropped into the $(NH_4)_2TiF_6$ solution as described below.

Reduction

In a 2 l vessel, the recrystallised $(NH_4)_2TiF_6$ from step 2 (500 g) was dissolved in tap water (1.5 l). The temperature was raised to 30° C. and a clear solution was obtained.

The Al(Hg)-buttons (150 g) prepared as described above were added to the $(NH_4)_2TiF_6$ solution, while stirring (no vortex). The reaction was exothermic and the temperature rose from 30 to 70° C. over a period of 75 minutes. After 15 minutes at 70° C., the suspension was cooled to below 30° C. and filtered.

The Al(Hg)-buttons were rinsed with water and stored in acetone. The violet precipitate was filtered and sucked as dry as possible and washed with water (2×50 ml).

Figure 5:
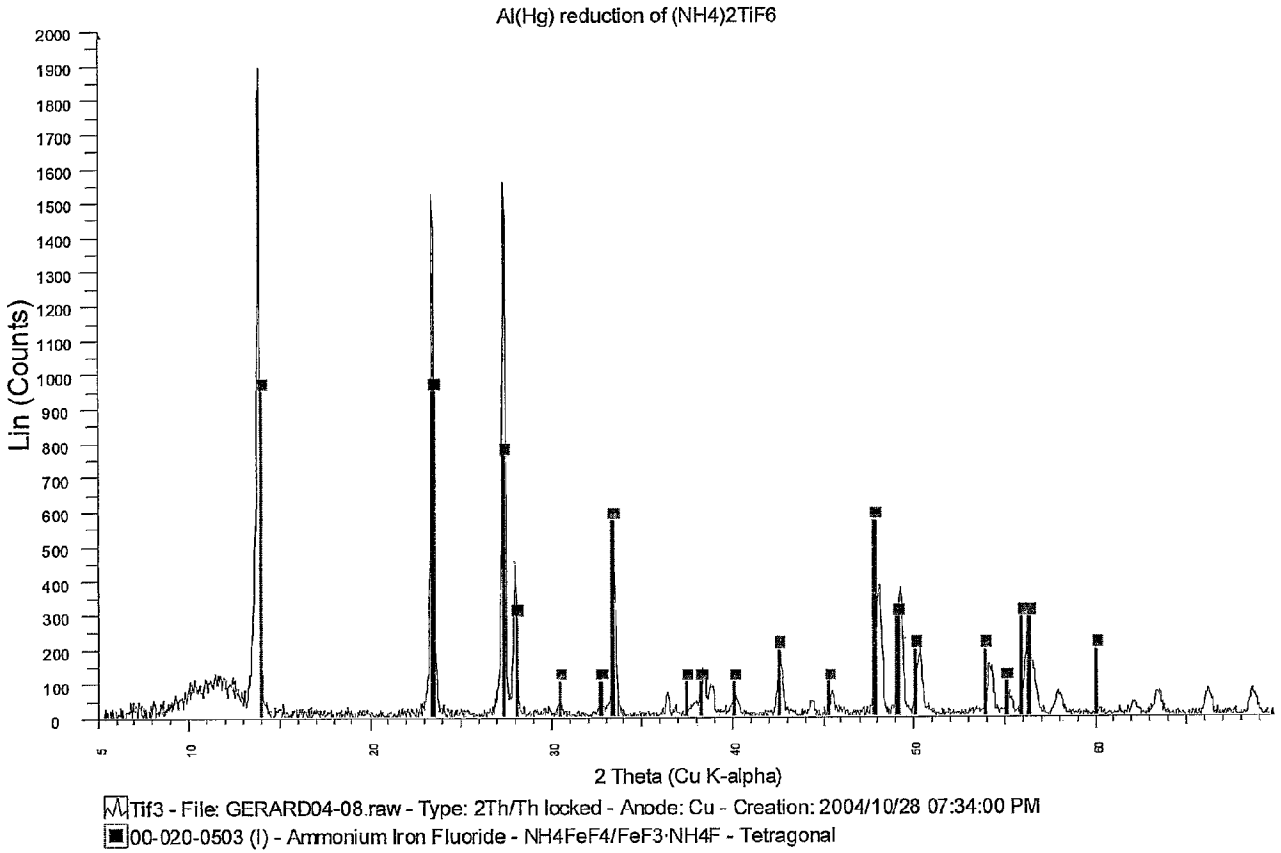
FIG. 5 is an x-ray diffraction pattern of $NH_4TiF_4$ produced by the reduction of $(NH_4)_2TiF_6$ with Al(Hg)

The violet precipitate was dried at 60° C. (yield 475 g). The product consisted of $NH_4TiF_4$ and $(NH_4)_3AlF_6$ in a weight ratio of approx 75%:25%. $NH_4TiF_4$ has a low solubility in dilute HF and an even lower solubility in concentrated HF. In this way, if necessary, the $(NH_4)_3AlF_6$ (and other impurities) could be washed out of the product. The XRD of this clean product is shown in FIG. 5.

It was also found that, if crude instead of pure $(NH_4)_2TiF_6$ was used, the Fe(II) present in the solution, plated onto the Al(Hg)-buttons and poisoned them. However, this only occurred after all of the Ti(IV) had been reduced to Ti(III). The Applicant believes that this method can be used to remove Fe, to the extent that recrystallisation of the $(NH_4)_2TiF_6$ may not be necessary. After reduction, the poisoned Al(Hg)-buttons could be re-activated by a dilute HCl leach to remove the Fe.

Step 4: Decomposition of $NH_4TiF_4$ and $(NH_4)_3AlF_6$

The reduction product from step 3, consisting of a mixture of $NH_4TiF_4$ and $(NH_4)_3AlF_6$, was decomposed at 600° C. under a nitrogen or argon atmosphere in a mild steel rotary. After 2-4 hours of soaking, the light brown-maroon product, consisting of $TiF_3$ and $AlF_3$, was completely free of $NH_4F$ which had evaporated. The evaporated material was condensed and collected. It was found that, if traces of $NH_4F$ remained, TiN formed during the reduction with Al at 750° C.

Depending on the ratio between $NH_4TiF_4$ and $(NH_4)_3AlF_6$, the yield of the decomposed product was typically between 60 and 70% of the feed.

Figure 6:
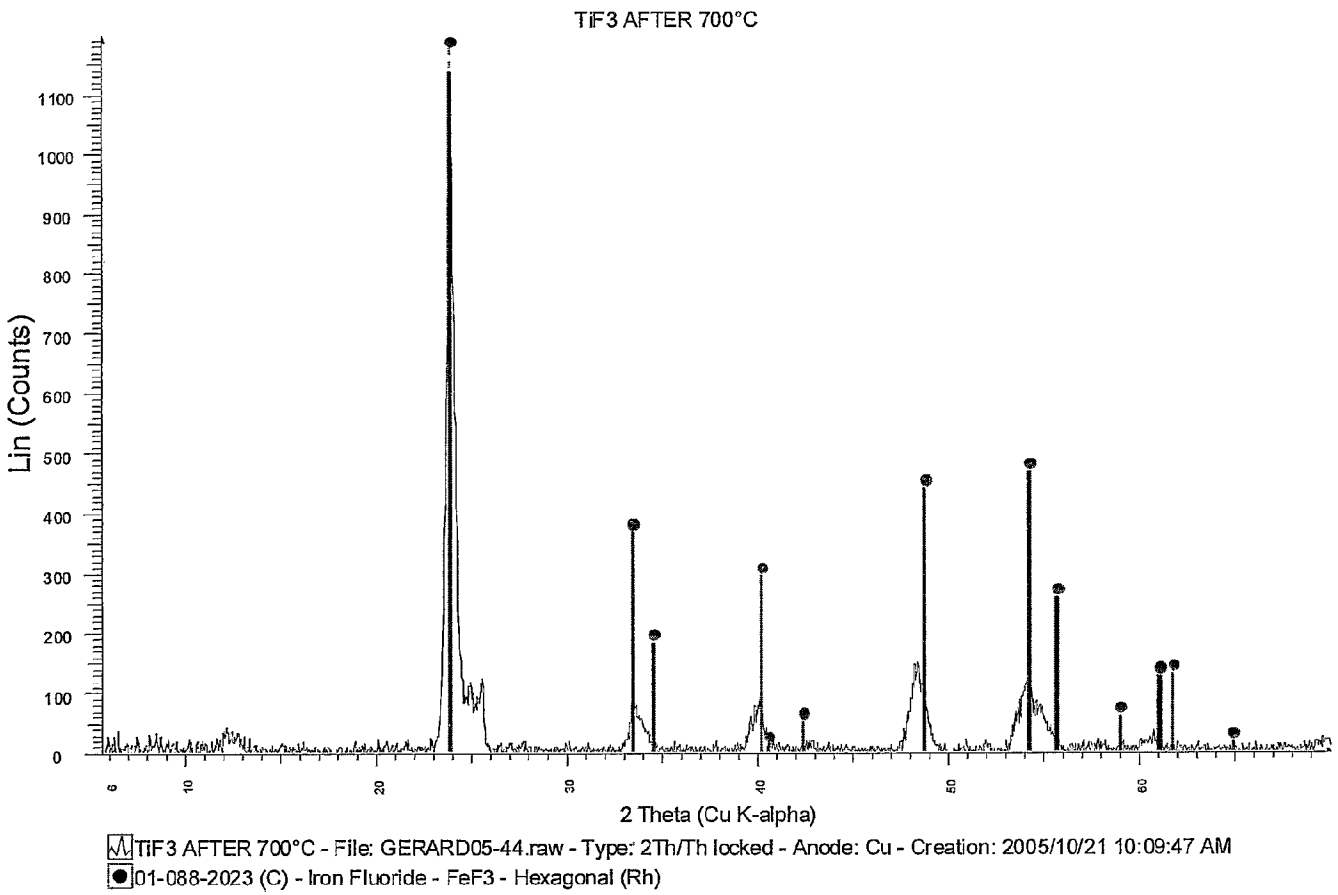
FIG. 6 is an x-ray diffraction pattern of $TiF_3$ produced by the decomposition of the $NH_4TiF_4$ of FIG. 5.

The XRD of clean $TiF_3$ produced from clean $NH_4TiF_4$ prepared as described above is shown in FIG. 6.

Figure 7:
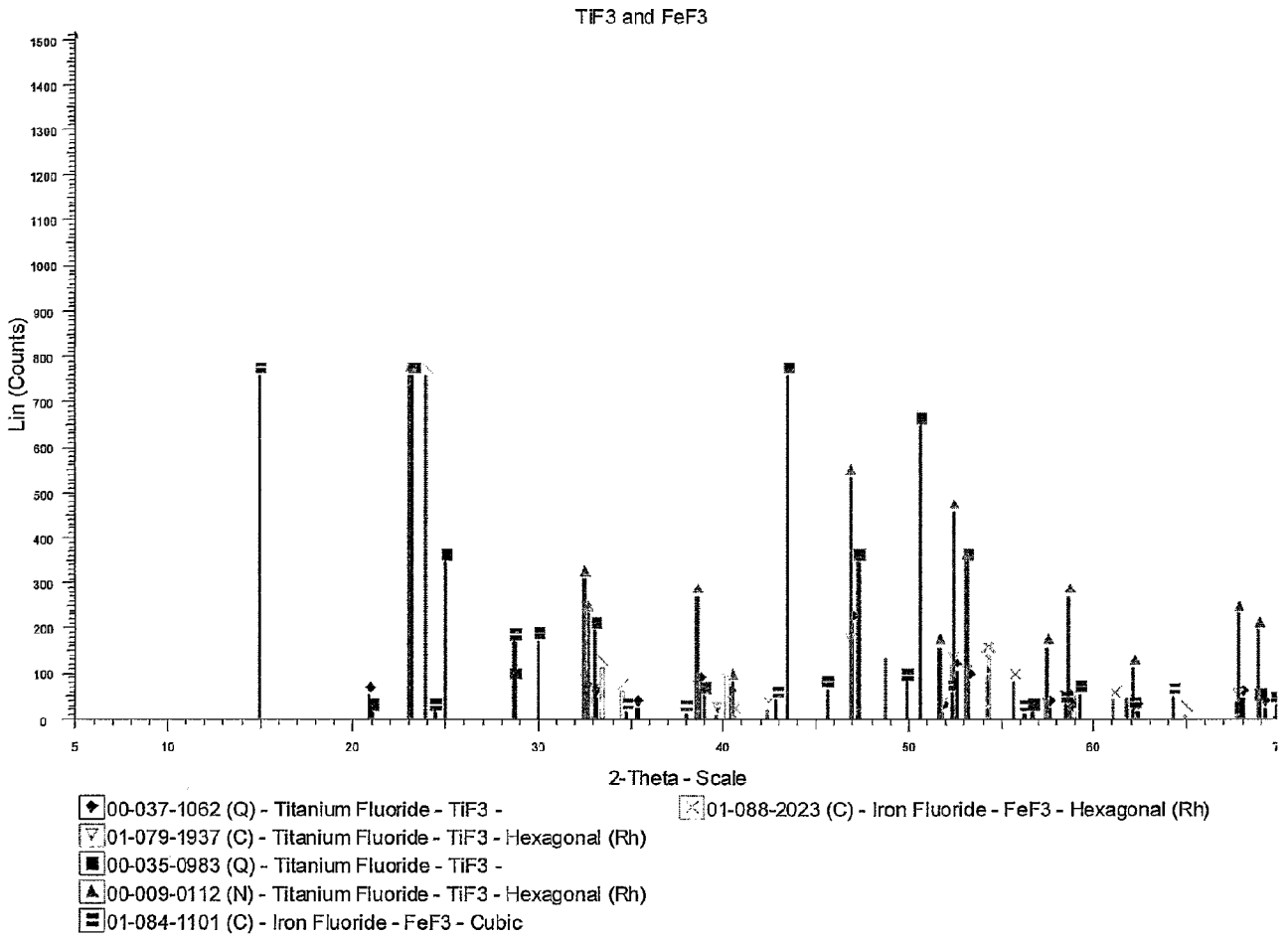
FIG. 7 shows superimposed x-ray diffraction patterns of standard samples of $TiF_3$ and $FeF_3$.

$NH_4TiF_4$ is a hitherto unknown salt and there is accordingly no data with which to compare the XRD powder pattern of $NH_4TiF_4$ as shown in FIG. 5. The closest XRD fit to this salt is the XRD of $NH_4FeF_4$. It is therefore not unexpected that the decomposed product, $TiF_3$ of $NH_4TiF_4$ best matches the XRD powder pattern of $FeF_3$. The XRD powder patterns of standard samples of $FeF_3$ and $TiF_3$ are shown in FIG. 7.

Step 5: Reduction of $TiF_3$ with Al and Sublimation of $AlF_3$

Figure 8:
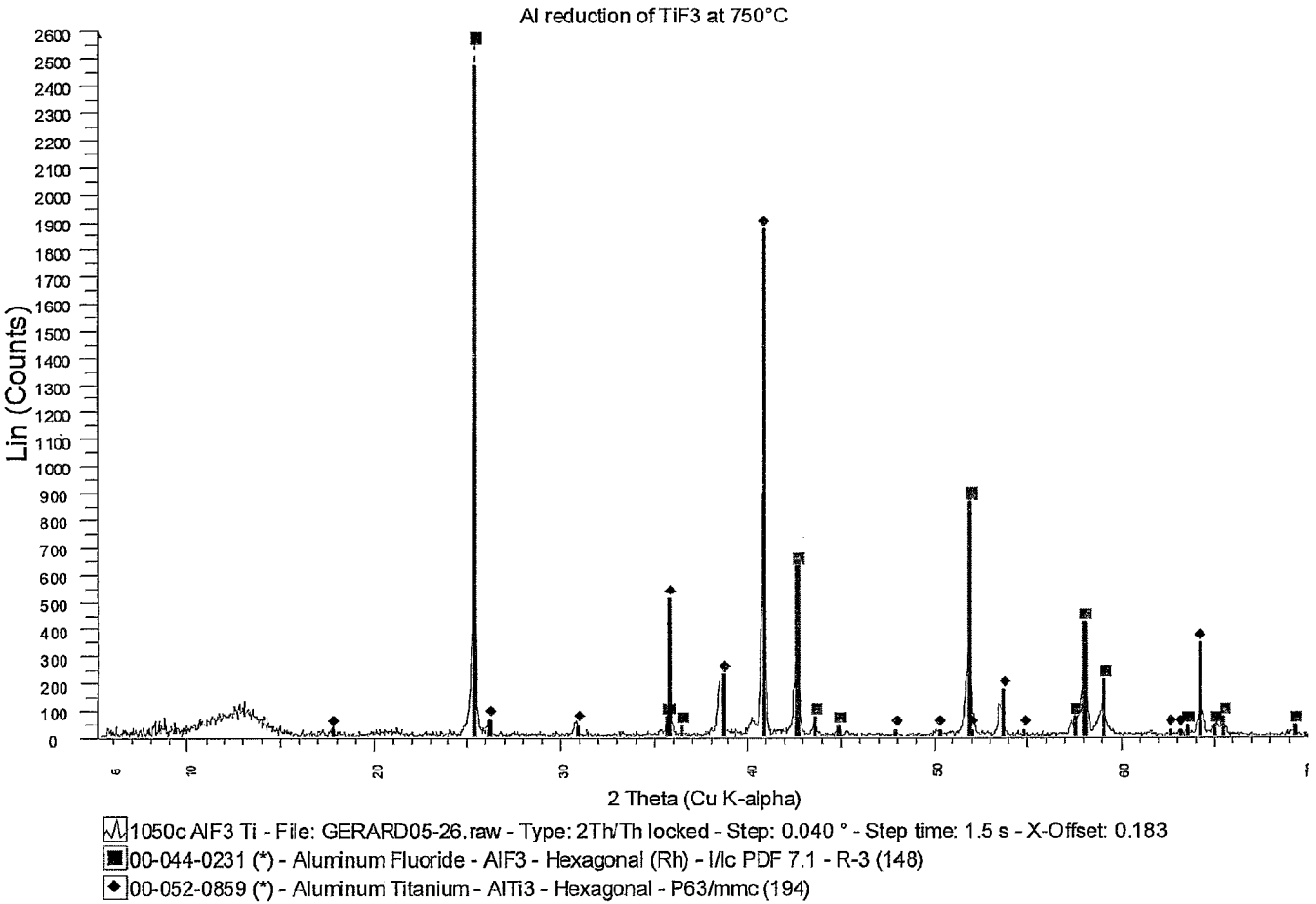
FIG. 8 is an x-ray diffraction pattern of the reduction product of $TiF_3$ with aluminium at 750° C.

After determining the ratio between $TiF_3$ and $AlF_3$ in the product produced in step (4), Al-powder (<125 μm) was mixed with the product. A stoichiometric amount of Al to $TiF_3$, was used (1 mol:1 mol). The mixture was placed in a mild steel crucible under an argon atmosphere and heated to 750° C. After 2 hours of soaking, the reduction was complete without any change in mass. The XRD of this material is shown in FIG. 8.

It was found that, for the reduction to be complete in a static unit, the coarsest Al powder that could be used was <125 μm. It is expected that, in a rotary unit, liquid Al may completely wet the $TiF_3$ and thus complete the reduction. Alternatively, the Al may be dissolved in Zn to increase the surface area of the Al to complete the reduction. After reduction, the Zn could be evaporated at 950° C., condensed and re-used in the next run.

Figure 9:
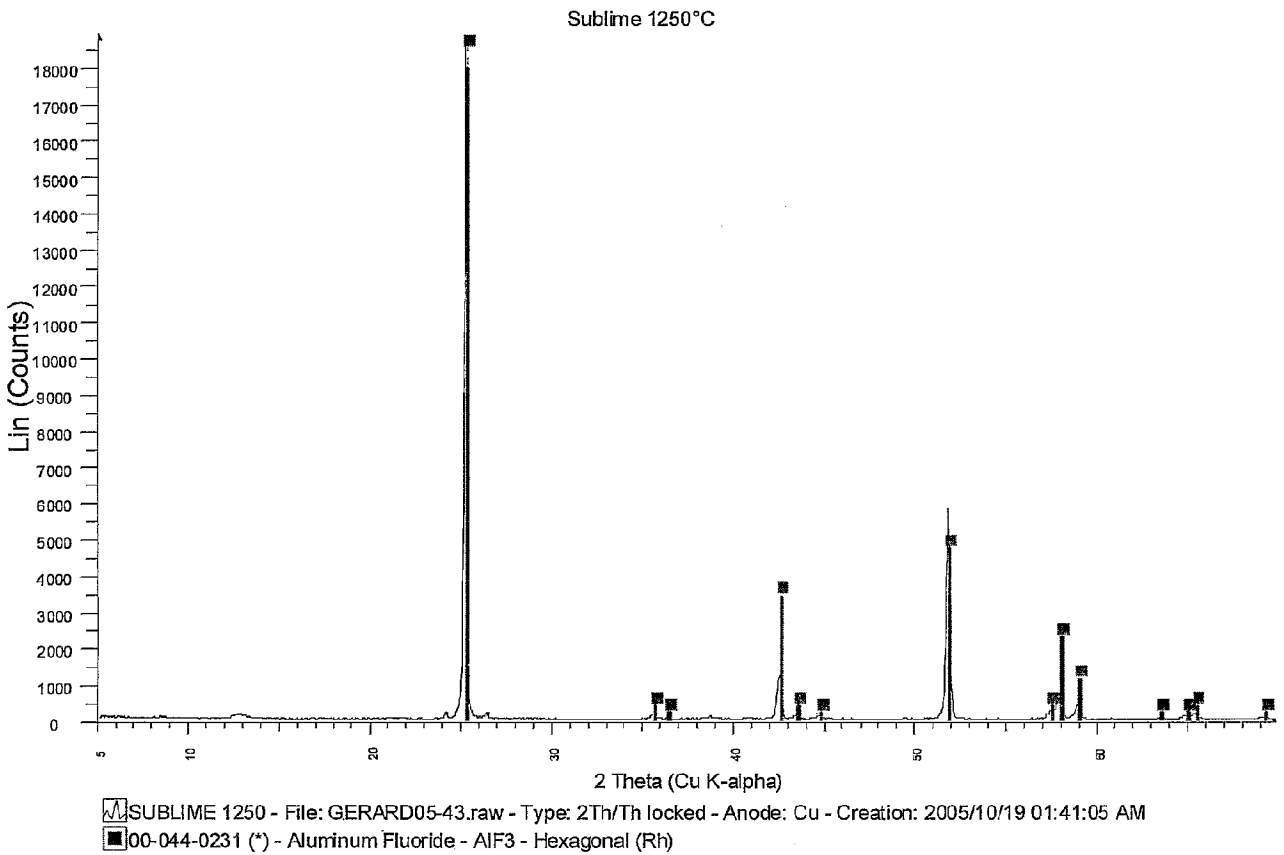
FIG. 9 is an x-ray diffraction pattern of $AlF_3$ sublimed at 1250° C.
Figure 10:
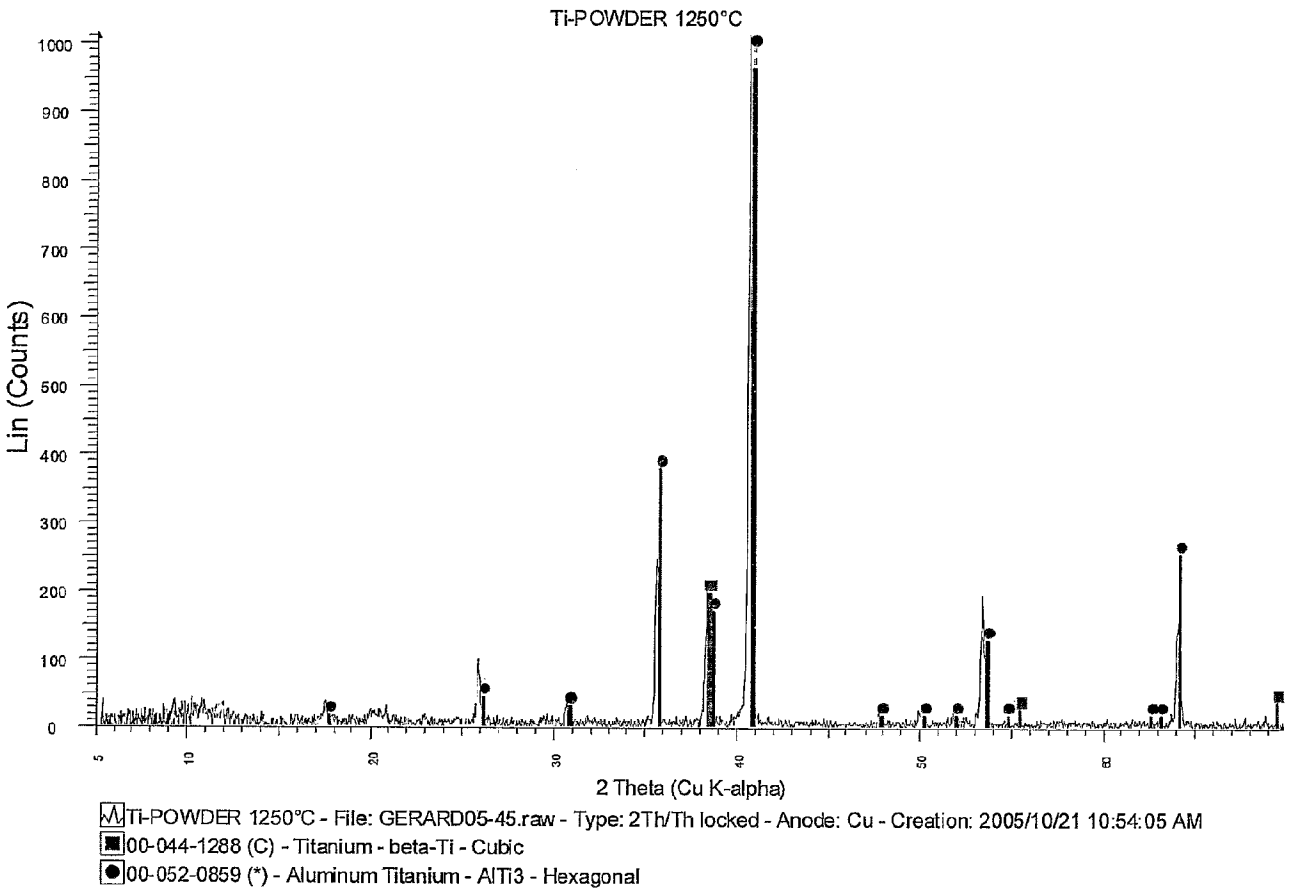
FIG. 10 is an x-ray diffraction pattern of the product of FIG. 8 after sublimation of $AlF_3$.

After reduction at 750° C., the temperature was raised to 1250° C., still under an argon atmosphere. At this temperature the $AlF_3$ sublimed and was condensed and collected as a pure by-product. The XRD of the $AlF_3$ is shown in FIG. 9. When the production of white fumes stopped, the sublimation was complete. Depending on the batch size and surface area, soaking at this temperature was between 2 and 10 hours. After cooling, the product Ti-powder was collected. The XRD of the powder is shown in FIG. 10.

The Applicant has found that complete sublimation of $AlF_3$ may be undesirable and that it is preferable to leave a trace amount (0.1-5%) to coat the Ti-powder. It was found that this fluoride coating protected the powder and increased safety when handling and transporting the powder. Prior art commercial Ti-powders have a spontaneous combustion temperature of approximately 250° C. in air. However, this temperature is increased to >600° C. if the inert $AlF_3$ layer is present. When the powder is melted or sintered (powder metallurgy) the $AlF_3$ layer will sublime and not contaminate the titanium product.

Figure 15:
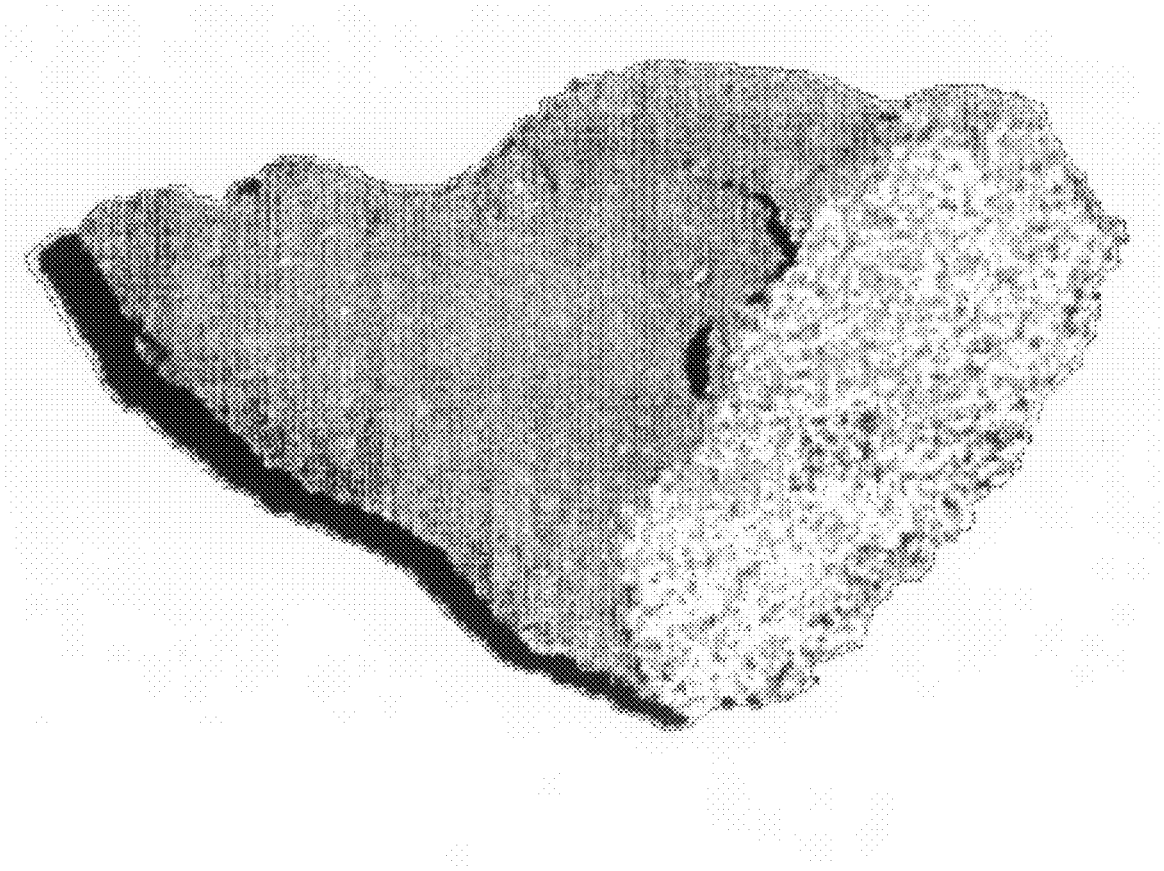
FIG. 15 shows the titanium powder of FIG. 10 after soft sintering at 1250° C.

It was also found that a metal crust formed on top of the Ti-powder at 1250° C. (refer to FIG. 15). It is believed that this crust contains metal impurities which migrated with the $AlF_3$ gas to the surface of the powder and precipitated there as the $AlF_3$ sublimed, analogous to zone refining.

Step 6: Melting of Ti-Powder

Figure 11:
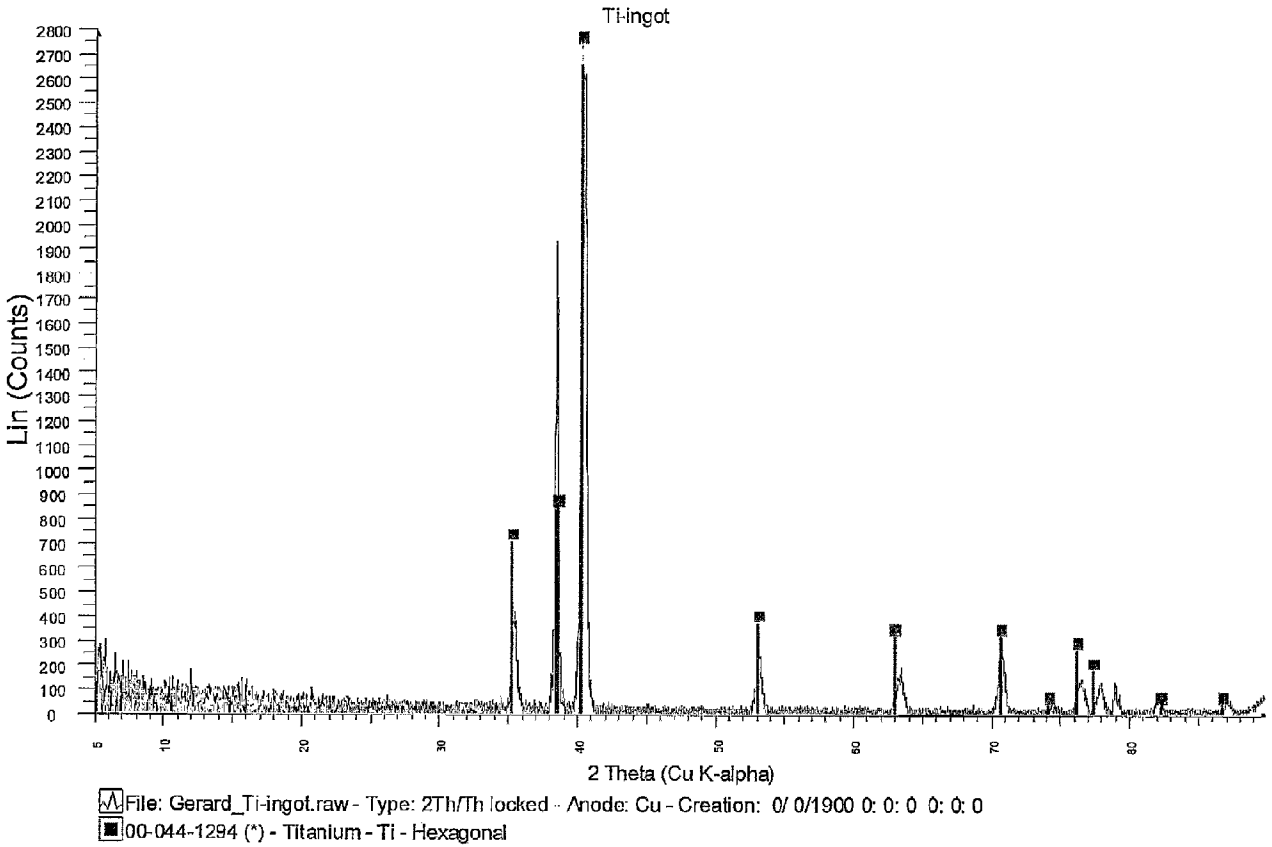
FIG. 11 is an x-ray diffraction pattern of titanium metal produced from the powder of FIG. 10.

The Ti-powder produced in step (5) was pressed inside a zirconia lined clay crucible and melted in an induction furnace under an argon atmosphere. It readily melted to form a small ingot and a trace amount of $AlF_3$ in the form of fumes was produced. The XRD of the metal is shown in FIG. 11. The Ti-powder or metal produced in this way contained very low levels (<Ti-grade 1) of oxygen, nitrogen, carbon and hydrogen due to the fluoride protection described above.

Figure 12:
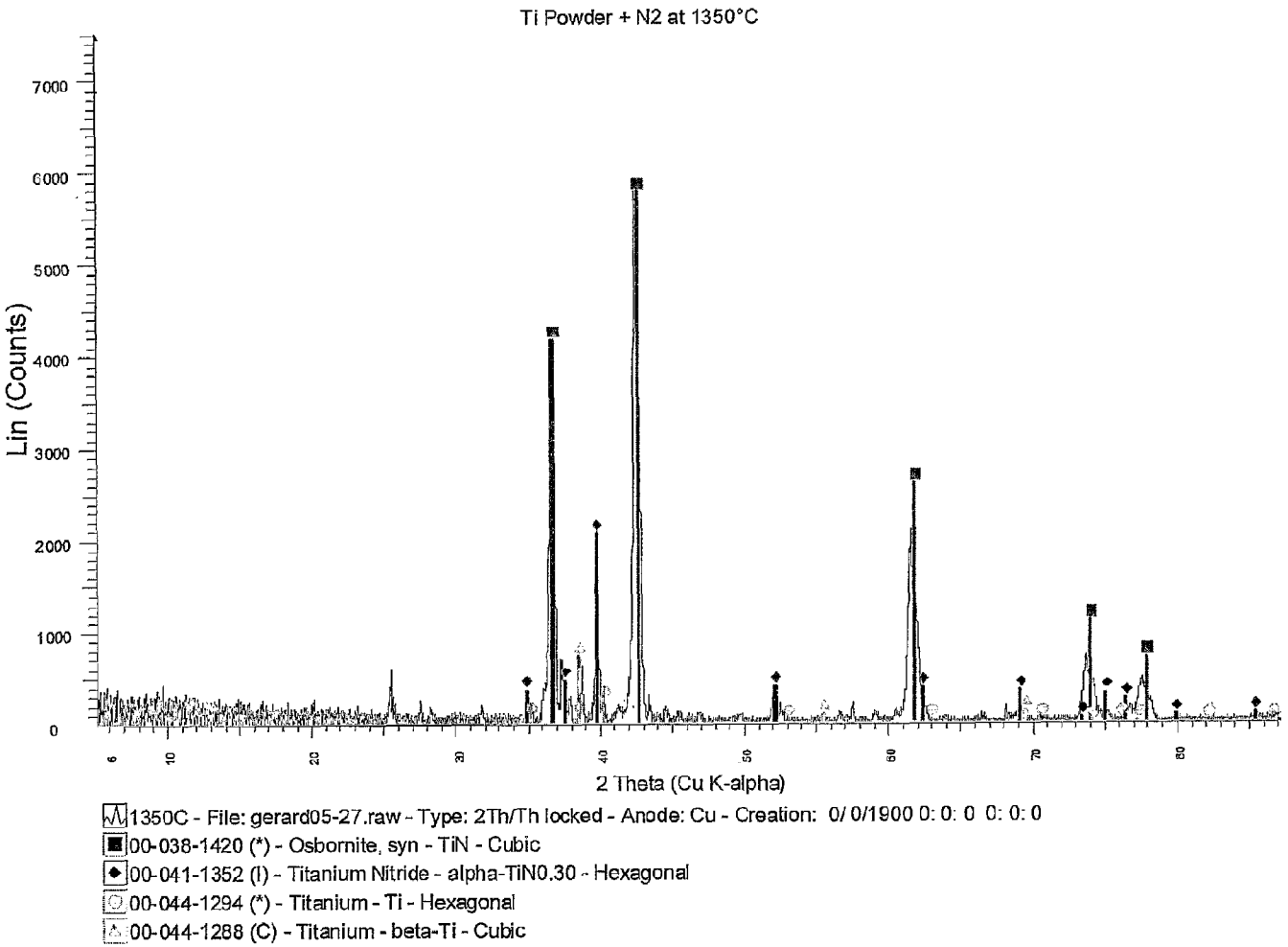
FIG. 12 is an x-ray diffraction pattern of titanium nitride formed by exposing the titanium powder of FIG. 10 to nitrogen at 1350° C.

As can be seen from the XRD of the Ti-ingot, the process of the invention allows Ti to be produced by reduction with Al without the formation of Al—Ti alloys. Although the XRDs of the Ti-powder after reduction as shown in FIG. 8 and after sublimation as shown in FIG. 10, appear to reveal the presence of the $AlTi_3$ phase (instead of Ti phases only), the Applicant believes that the $AlTi_3$ phase which is apparently shown in the XRDs is only a pseudo $AlTi_3$ phase and that there is, in fact, no Al present. The reason why the "$Ti_3$" has the $AlTi_3$ crystal structure is because it was "born" from Al and, at the low temperature used (<1300° C.), there is not enough energy to re-arrange the titanium crystal structure. Rearrangement of the titanium crystal structure only takes place when the Ti is melted or reacted with something else, such as $N_2$, to form TiN. FIG. 12 shows the XRD where the Ti-powder was exposed to a limited amount of $N_2$ at 1350° C. As can be seen no Al or Al alloy phase was detected.

This was also confirmed by the fact that the XRD of the reduced Ti-powder with Al (FIG. 8), showed that only the phases $AlF_3$ and $AlTi_3$ were present. Because a stoichiometric amount of Al to $TiF_3$ was used, if Al does, in fact, alloy with Ti to form $AlTi_3$, there should be 25% unreacted $TiF_3$ present and this does not show on the XRD.

The main reason why Ti can be reduced by Al without alloying is the fact that, during reduction, Al reacts with Ti(III) and not Ti(IV). The former reaction is moderately exothermic while the latter reaction is violently exothermic:

$$TiF_3+Al=Ti+AlF_3 \Delta G=-80 \text{ kJ/mol Ti, } [\log(K)=4]$$

$$TiF_4+1\tfrac{1}{3}Al=Ti+1\tfrac{1}{3}AlF_3 \Delta G=-300 \text{ kJ/mol Ti, } [\log(K)=15]$$

Alloying occurs when two metals are in contact with one another and there is enough energy to form an alloy.

In the first reaction the energy was too low to make alloying possible. The presence of $AlF_3$ also helped to maintain the temperature at less than 1100° C. which is when $AlF_3$ starts to sublime thus absorbing the energy.

It is evident that the first electron reduction of Ti(IV) to Ti(III) is highly exothermic. In the process of the invention, that energy is absorbed in water during the controlled aqueous reduction of $(NH_4)_2TiF_6$ with Al(Hg).

EXAMPLE 2

Preparation of Titanium-Vanadium Alloy

Step 1: Preparation of $NH_4VF_4$ and $VF_3$

To manufacture Ti-alloys, such as Ti-6Al-4V, the alloying elements in the form of their metal fluorides were mixed in the correct ratio with $TiF_3$ prior to reduction with Al. In the case of Ti-6Al-4V, $VF_3$ was added to $TiF_3$ and 6% excess Al was used during the reduction to produce the alloy-powder, after sublimation of $AlF_3$.

The V could not be introduced as $VF_5$ or $VF_4$ due to the low boiling points of these compounds since they would sublime before reduction could take place. It was therefore necessary to produce $VF_3$ as the V precursor as set out below.

$NH_4VO_3$ (58.5 g) was added to water (300 ml) and stirred. $NH_4Cl$ (53.5 g) and HF (40%; 130 ml) were added to the resulting solution to produce a yellow solution.

Fe (14 g, steel wool) was added to the solution to reduce the V(V) to V(IV). The reaction was exothermic and a blue solution was produced. After the reaction was completed, approximately 1 hour later, the solution was filtered to remove trace amounts of iron residue.

$$NH_4VO_3+6HF+\tfrac{1}{2}Fe+2NH_4Cl=(NH_4)_2VF_6+\tfrac{1}{2}(NH_4)_2FeCl_4+H_2O$$

The temperature of the blue solution was adjusted to 20° C. and then reduced with Al(Hg)-buttons. Over a period of approx 3 hours, the temperature increased to about 40° C. When the reduction of V(IV) to V(III) had completed, Fe plated onto the Al(Hg)-buttons and the reduction stopped.

Figure 13:
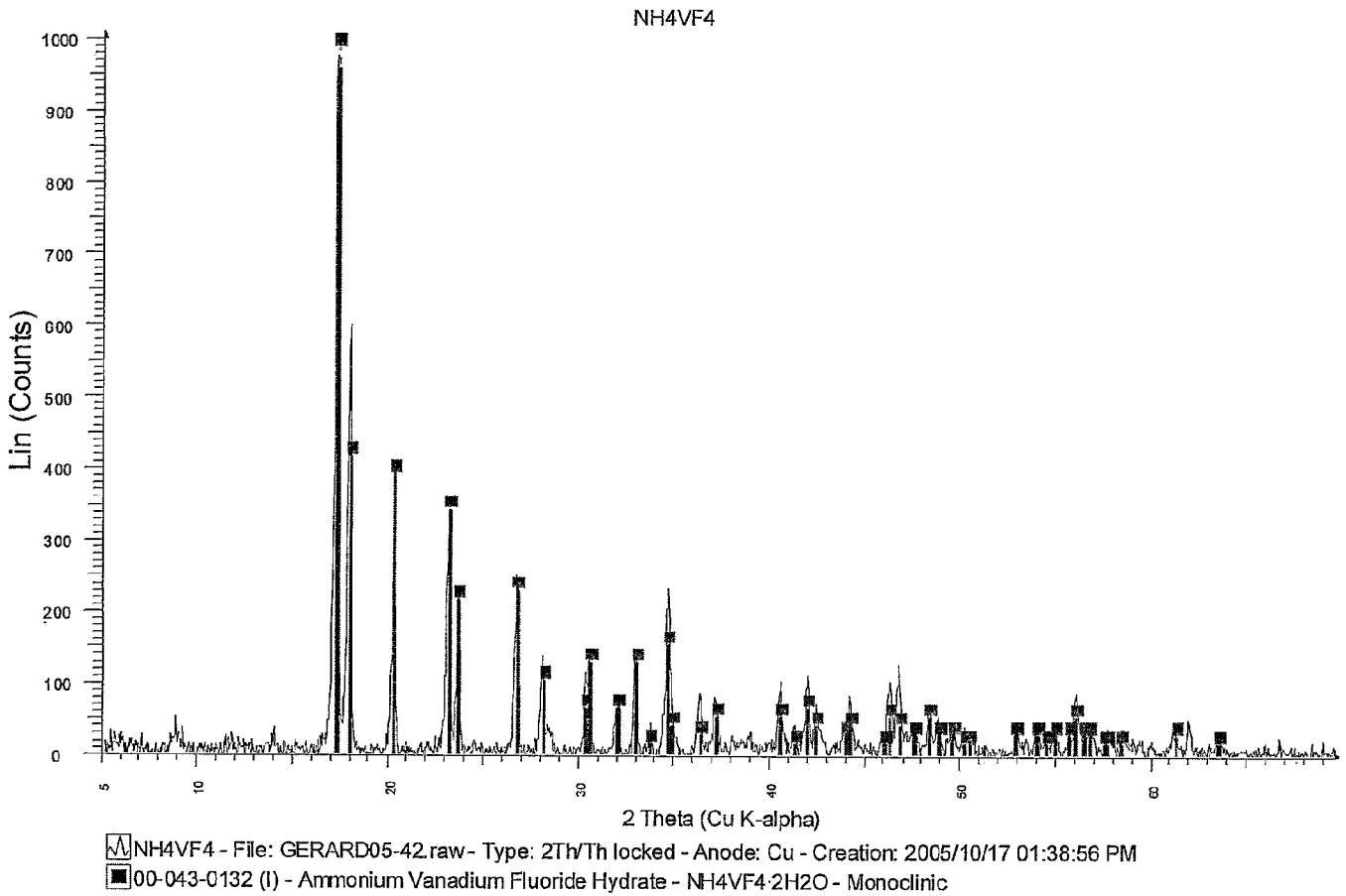
FIG. 13 is an x-ray diffraction pattern of $NH_4VF_4$ produced by the reduction of $(NH_4)_2VF_6$ with Al(Hg)

The resulting green suspension was then filtered and dried as for $NH_4TiF_4$ described above. The yield of peppermint green $NH_4VF_4.2H_2O$, was 67 g. The XRD of this product is shown in FIG. 13.

Al(Hg) was not used to reduce V(V) to V(IV) because the reaction was extremely violent and too much $(NH_4)_3AlF_6$ precipitated during the reaction.

Step 2: Preparation of the Alloy

Figure 14:
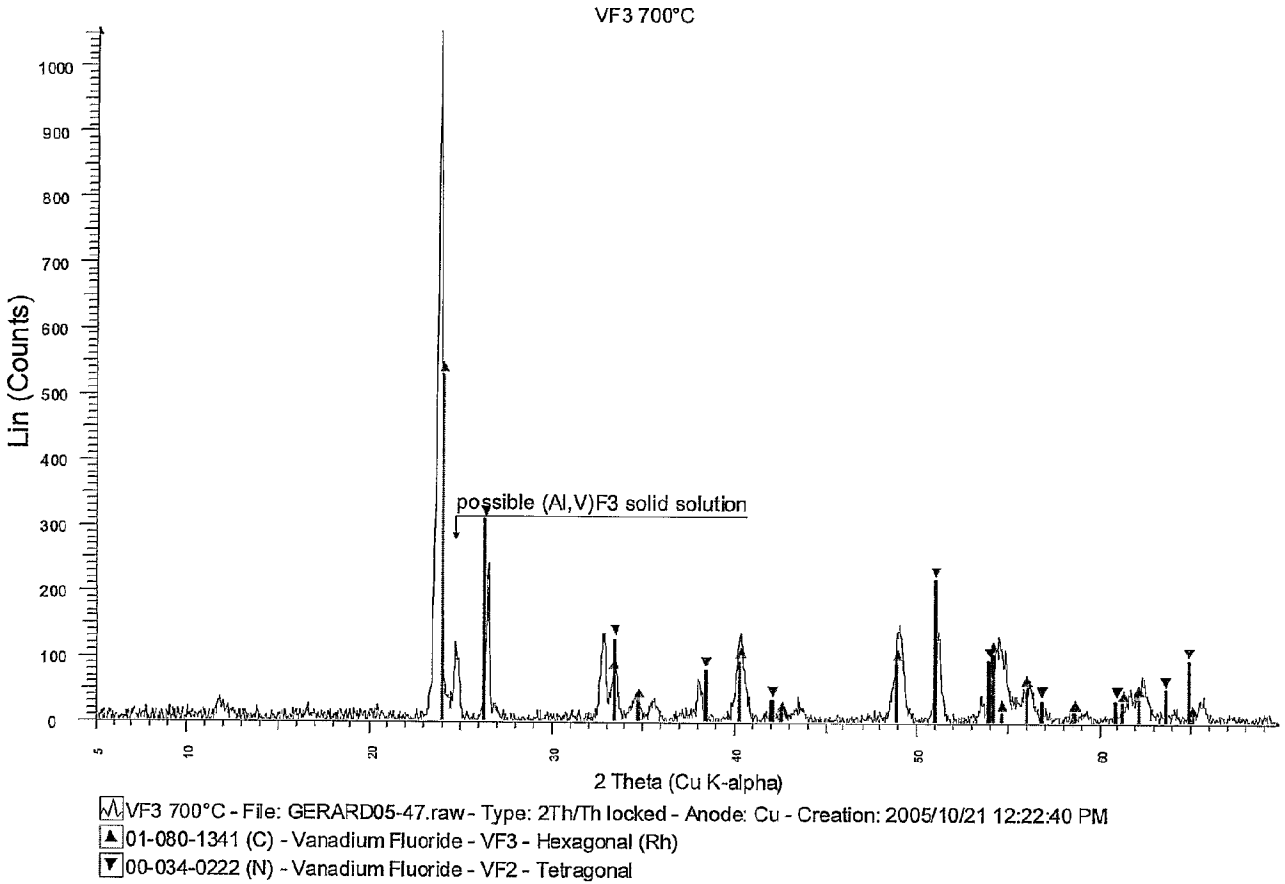
FIG. 14 is an x-ray diffraction pattern of $VF_3$ produced by the decomposition of the $NH_4VF_4$ shown in FIG. 13.

As for $NH_4TiF_4$, $NH_4VF_4.2H_2O$ was also decomposed at 700° C. to produce dark green $VF_3$ (+$AlF_3$). The XRD of this product is shown in FIG. 14. After establishing the ratio between $VF_3$ and $AlF_3$, this powder was mixed with $TiF_3$ (+$AlF_3$) to produce the alloy powder after reduction and sublimation.

EXAMPLE 3

Regeneration of $NH_4Cl$ from $(NH_4)_2FeCl_4$ Solution

A problem which arises if $Fe(OH)_2$ is precipitated with $NH_4OH$ from the $(NH_4)_2FeCl_4$ solution produced as a by-product of the selective precipitation step, as described in step 2 of Example 1 above, is its solubility in high concentrations of $NH_4Cl$. This results in very slow precipitation. Furthermore, air oxidation of $Fe(OH)_2$ to FeO(OH) (low solubility in $NH_4Cl$) is slow and not practical and oxidation with $H_2O_2$ works well but the reagent is expensive.

The Applicant has found that the oxidation of Fe(II) to Fe(III) can be enhanced by conducting a current through the solution. The following reactions take place:

$$(NH_4)_2FeCl_4 + \text{current} = Fe + Cl_2 + 2NH_4Cl$$

$$Cl_2 + 2(NH_4)_2FeCl_4 = 2FeCl_3 + 4NH_4Cl$$

$$2FeCl_3 + 6NH_4OH = 6NH_4Cl + 2FeO(OH) + 2H_2O$$

$$3(NH_4)_2FeCl_4 + 6NH_4OH + \text{current} = 12NH_4Cl + Fe + 2FeO(OH) + 2H_2O$$

Accordingly, the pH of 1 liter of the $(NH_4)_2FeCl_4$ solution produced in the selective precipitation step was increased to 4-5 by addition of $NH_4OH$ while stirring. As the solution/suspension was stirred, it was electrolysed using a car battery charger at a voltage of 6V and 2 graphite electrodes (any suitable electrodes can be used). A current of 6-9 amps was produced. This current also heated the solution to 60-70° C., which aided the reaction.

As the electrolysis progressed, the pH dropped and was frequently restored to 4-5 by addition of $NH_4OH$. During the process, no $Cl_2$ gas was produced as it was immediately converted to chloride by the oxidation of Fe(II) to Fe(III). After approximately 3 hours, the pH stopped dropping indicating that the reaction was complete. Overall, approximately 300 ml of $NH_4OH$ (25%) was used.

Plated Fe was recovered from the cathode and a brown-orange precipitate was readily filtered off. After drying at 80° C., 200 g of a product consisting mostly of FeO(OH) and some $TiOF_2$ and other impurities was obtained.

The filtrate was evaporated to yield $NH_4Cl$ (310 g). A crude mass balance indicated that more than 80% of the $NH_4Cl$ was recovered without washing the filter cake.

The plated Fe could be used in the process when iron reduction was carried out after digestion and to produce FeTi if needed.

EXAMPLE 4

Regeneration and HF Top-Up

The $NH_4F$ collected after the decomposition of the $NH_4$-precursors at 600° C., as described in step (4) of Example 1, was reacted with a slaked lime solution to form a $NH_4OH$ solution and precipitate $CaF_2$. $NH_4OH$ was used in the regeneration of $NH_4Cl$ from $(NH_4)_2FeCl_4$. The $CaF_2$ (fluorspar) produced can be sold as a by-product or treated with concentrated $H_2SO_4$ according to conventional processes to produce HF.

EXAMPLE 5

Production of $(NH_4)_2TiF_6$ from Anatase Pulp

Crude anatase pulp ($TiO_2.xH_2O$) is a well-known product obtained by the aqueous hydrolysis of a Ti-solution. Essentially, all Ti feedstock materials can be converted to crude anatase pulp. To produce a concentrated solution of $M^{II}TiF_6$, it was necessary to add $M^{II}$ to obtain a mole ratio close to 1 mol $M^{II}$:1 mol $Ti^{IV}$. In this example $M^{II}$ was $Zn^{2+}$.

ZnO (40.7 g, 0.5 mol) was added to tap water (65 ml) and stirred until the ZnO was wetted. HF (130 ml, 40%, 3 mol) was slowly added to the wetted ZnO. The reaction was exothermic and not all of the ZnO dissolved. $TiO_2.2H_2O$ (69.6 g, 0.6 mol) was then slowly added in four portions with vigorous stirring. The reaction was exothermic and the mixture started to boil. After addition of the third portion, a clear solution was obtained. After addition of the fourth portion, which contained excess pulp, a milky colour was produced. The use of an excess of the pulp ensured that all of the HF was consumed. After 1 hour, the solution was cooled to 40° C. and filtered. The filter cake was washed with water (1×20 ml). $NH_4Cl$ (117 g, 2 mol) was added to the leachate, (approximately 200 ml at 30° C.) with vigorous stirring to produce $(NH_4)_2TiF_6$ by the following reaction:

$$ZnTiF_6(aq)+4NH_4Cl(s)=(NH_4)_2TiF_6(ppt)+(NH_4)_2ZnCl_4(aq)$$

The temperature of the mixture initially dropped to below 5° C. and, after approximately 15 minutes of stirring, the temperature rose to about 10° C. and the mixture was filtered. The resulting crystalline $(NH_4)_2TiF_6$ was dried at 60° C. to produce 80.25 g of crystalline product. The yield was >80%. Higher yields (greater than 90%) were produced when the process was scaled up.

Unexpectedly, it was found that $(NH_4)_2TiF_6$ was not produced if the order of the reaction was reversed. If the crude anatase pulp was first digested in HF to produce aqueous $H_2TiF_6$ and the ZnO was then slowly dissolved in the $H_2TiF_6$ solution, a clear solution was produced. However, when $NH_4Cl$ (s) was added to the solution, the Ti did not precipitate as $(NH_4)_2TiF_6$ but instead, hydrolysis to a white insoluble precipitate occurred.

EXAMPLE 6

Production of $(NH_4)_2TiF_6$ from Rutile, Brookite, Leucoxene and Titaniferous Slag Similar results were obtained when the process of Example 5 was followed for the production of $(NH_4)_2TiF_6$ using rutile, brookite, leucoxene or titaniferous slag.

EXAMPLE 7

Production of $(NH_4)_2TiF_6$ from Anatase, Rutile, Brookite, Leucoxene and Titaniferous Slag Similar results were obtained when the process of Example 5 was followed using MgO in place of ZnO for the production of $(NH_4)_2TiF_6$ from anatase, rutile, brookite, leucoxene or titaniferous slag.

EXAMPLE 8

Production of Titanium from Ilmenite Via Na Reduction of $Na_2TiF_6$

Figure 16:
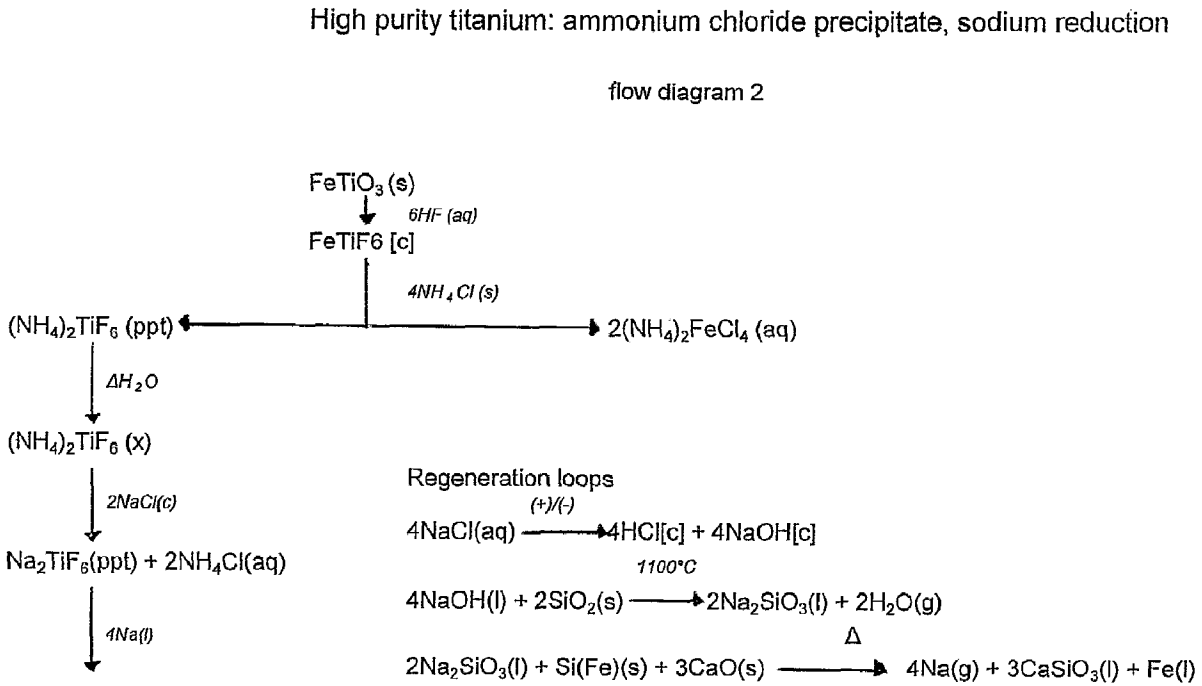
FIG. 16 is a flow diagram of the sodium reduction route.

Referring to FIG. 16, Ilmenite (800 g) was digested, with stirring, with 20% aqueous HF (1.5 l) in a 2 liter polypropylene beaker with a loose lid. The slurry began to boil (100° C.) after about ten minutes and boiled for about 5 minutes. The reaction mixture then began to cool. After 1 hour the temperature had dropped to 74° C. Steel wool (12 g) was then added to reduce all iron(III) to iron(II) and the reaction mixture was stirred for another hour. The resulting saturated solution of $FeTiF_6$ (1 mol Ti=438 ml leachate) was filtered to remove insoluble material and excess ilmenite (which was recycled). The resulting leachate (1.5 l) contained 164 g of dissolved titanium. Solid $NH_4Cl$ (49.4 g; 5% excess) was added to the leachate (876 ml) and the temperature dropped to about 10°

C. The resulting solution was stirred for 1 hour in a water bath at 20° C. Filtration produced $(NH_4)_2TiF_6$ (454 g) as a moist white crystalline product containing 68 g water (equal to a dry weight of 386 g). The theoretical yield is 395.8 g for 2 moles of $(NH_4)_2TiF_6$. The selective precipitation accordingly has an efficiency of 97.5% and produces a product with a purity of about 98%. The moist filter cake was then washed with a minimum amount of a saturated $NH_4Cl$ solution (approximately 75 ml), to yield a moist crystalline product (442 g). This product contained about 66 g of water (equal to a dry weight of 376 g). indicating an efficiency of 95% and a purity of about 99%.

Water (332 ml) was added to the moist crystalline product (442 g) and the solution was boiled at 98° C. All of the crystalline product dissolved and the solution was then cooled to 10° C. The resulting mixture was filtered and the moist filter cake was washed with a minimum amount of ice water (approximately 60 ml), to yield a moist recrystallised $(NH_4)_2TiF_6$ product (242 g) containing about 37 g water (equal to a dry weight of 205 g and a purity of >99.9%). The mother lye and wash solution were recycled.

Dry NaCl (121.2 g) and water (300 ml) were added to the moist $(NH_4)_2TiF_6$ (242 g) and stirred for 30 minutes and the mixture was filtered. The filter cake was washed with a minimum amount of a saturated NaCl solution (approximately 50 ml) and dried at 60° C. to yield very pure crystalline $Na_2TiF_6$ (210 g).

This product was added to sodium metal (115 g; 20% excess) in a 750 ml stainless steel crucible fitted with a loose lid under an argon atmosphere. The crucible was placed in a muffle furnace (still under argon) and heated to about 700° C. At this temperature an exothermic reaction took place and the temperature spontaneously rose to about 900° C. The crucible was kept at about 900° C. for a further 30 minutes to ensure that all of the excess sodium had evaporated, and then allowed to cool.

After the crucible had cooled to room temperature, the argon flow was stopped and a product consisting of NaF and titanium (about 270 g) could be removed from the crucible (theoretical yield 300 g) in the form of pieces having a size of about 2-15 mm. Some of the product adhered to the crucible. This granular product was placed in a 250 ml sealed zirconia crucible and heated to 1700° C. under a closed argon atmosphere, for 10 min and allowed to cool to room temperature. A titanium ingot (approximately 40 g; >99.9%) under a NaF slag was recovered.

The recycling of NaF was tested via a separate experiment. NaF (42 g; −500 um) and concentrated HCl (100 ml; 32%) solution were added to a 250 ml beaker with a loose lid and stirred at room temperature for 2 hours to produce an aqueous HF solution. Fine crystalline NaCl (57 g after drying at 120° C.; >98%) was filtered from the solution (96 ml). The HF was evaporated to a volume of 84 ml to obtain a 20% HF solution (indicating an efficiency of about 95%).

After the selective precipitation of $(NH_4)_2TiF_6$ from $FeTiF_6$ by the $NH_4Cl$, the filtrate contained the double salt $(NH_4)_2FeCl_4$ and some trace elements which behave in the same way as Fe. $NH_4Cl$ was regenerated as described in Example 3.

HCl and NaOH were recovered by electrolysis of a saturated NaCl solution. This is a well known industrial process and is used for example at the Chloorkop installation in South Africa on a kiloton scale.

Sodium silicate was recovered from sodium hydroxide and silica as is well known in, for example, the glass industry, and the sodium silicate was converted to sodium via Si(Fe) according to known methods.

EXAMPLE 9

Production of Titanium from Ilmenite Via Mg Reduction of $Na_2TiF_6$

Figure 17:
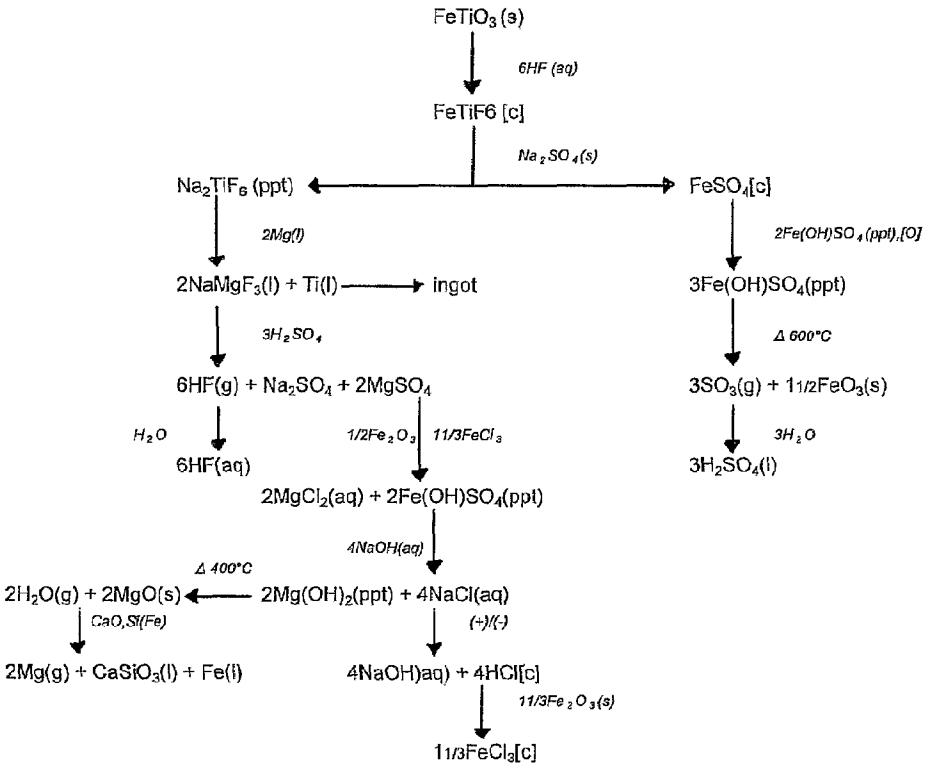
FIG. 17 is a flow diagram of the magnesium reduction route.

Referring to FIG. 17, Ilmenite (800 g) was digested, with 20% aqueous HF to produce a leachate as described in Example 1. Sodium sulphate (149 g; 5% excess) was added to the leachate (438 ml) and the solution was stirred for 1 hour at 20° C. The resulting suspension was filtered to produce a moist, white crystalline product which was washed with a minimum amount of a saturated $Na_2SO_4$ solution (approximately 3×25 ml) and dried at 60° C., to give a crystalline $Na_2TiF_6$ product (195 g; indicating an efficiency of 94% and a purity of about 99%).

The dried crystalline $Na_2TiF_6$ product (195 g) was added to magnesium filings (57 g; 20% excess) in a 750 ml stainless steel crucible with a loose lid under an argon atmosphere. The crucible was placed in a muffle furnace (still under argon) and heated to about 700° C. At this temperature an exothermic reaction took place and the temperature spontaneously rose to about 900° C. The temperature was then raised to about 1100° C. and kept at this temperature for about 30 minutes to ensure that all of the excess magnesium evaporated, and then allowed to cool.

After the crucible had cooled to room temperature, the argon flow was stopped and the product consisting of a mixture of $NaMgF_3$ and titanium was recovered from the crucible. Because of the iron content of the precursor, only Ti-grade 4 was obtained by melting the product at 1700° C.

The recycling loops shown in FIG. 17 are well known commercial processes.

EXAMPLE 10

Preparation of Titanium Nitride, Carbide, Boride, Hydride, Silicide, Phosphide and Sulphide The deactivated titanium powder of Example 1 was heated in the presence, respectively, of gaseous nitrogen, carbon in the form of carbon powder or coke, diborane, gaseous hydrogen, powdered silicon, phosphine and powdered sulphur to produce titanium nitride, carbide, boride, hydride, silicide, phosphide and sulphide respectively.

ADVANTAGES

There are several clear advantages associated with the process of the invention when compared with prior art processes.

(1) Firstly, the process of the invention uses inexpensive starting materials, such as ilmenite, which is readily available in large quantities.

(2) The by-products produced in the process are all recycled and there is consequently very little overall reagent consumption.

(3) The process of the invention also provides a route to titanium which involves a protective fluoride coating as described above.

(4) It is a further advantage of the process of the invention that the intermediate $(NH_4)_2TiF_6$, which was previously not commercially available, is used instead of a precursor such as $TiCl_4$. The salt $(NH_4)TiF_6$ is stable in air and water, it is non-corrosive and is easy to prepare in an aqueous medium at ambient temperature. On the other hand, $TiCl_4$ is a very toxic liquid which decomposes violently in air and water and is highly corrosive. It is difficult to prepare, requiring temperatures of the order of 1000° C. and is in the gas form during the reduction step. Titanium produced via $TiCl_4$ is expensive and is prone to contamination by O, N, H and C because of the absence of the fluoride coating associated with the method of the invention.

(5) It is a further major advantage that the titanium produced in accordance with the method of the invention has a cost comparable with that of high grade stainless steel.

(6) It is a further advantage that aluminium, which is substantially cheaper than either sodium or magnesium (as used in prior art processes), is used in the reduction step, without any aluminium alloy formation in the end product.

(7) Furthermore, the process of the invention produces titanium powder at a temperature well below the melting point of titanium. This results in substantially cheaper pyrometallurgical operations. This powder can then be used in classical powder metallurgy techniques to produce near net shape articles. This results in substantially less wastage when compared with prior art processes using titanium ingots. However, if titanium ingots are required the powder can readily be melted in a single stage melting process for example in an induction furnace because it is protected by the $AlF_3$ coating. The $AlF_3$ additionally acts as a flux during the melting of the powder.

(8) It is a particular advantage of the invention that, when preparing titanium alloys as described in Example 2, the other metal fluoride salt or salts can readily be homogeneously mixed with $TiF_3$ so that a homogeneous dispersion of the other metal or metals in the alloy is obtained. Prior art methods of producing homogeneous alloys by mixing the molten metals are practically very difficult.

(9) It is a further advantage of the invention that the process can be carried out using technical grade aqueous HF which is substantially cheaper than chemically pure aqueous HF.

Table 1 shows for comparison purposes the typical chemical composition, mechanical properties and physical properties of commercially available corrosion-resistant titanium alloys.

TABLE 1

CHEMICAL COMPOSITION (NOMINAL %)

| Grade | Carbon Max | Oxygen Max | Nitrogen Max | Iron Max | Al | V | Pd | Mo | Ni | Hydrogen Max |
|---|---|---|---|---|---|---|---|---|---|---|
| 1 | 0.08 | 0.18 | 0.03 | 0.2 | | | | | | 0.015 |
| 2 | 0.08 | 0.25 | 0.03 | 0.3 | | | | | | 0.015 |
| 3 | 0.08 | 0.35 | 0.05 | 0.3 | | | | | | 0.015 |
| 4 | 0.08 | 0.40 | 0.05 | 0.5 | | | | | | 0.015 |
| 5 | 0.08 | 0.20 | 0.05 | 0.4 | 6 | 4 | | | | 0.015 |
| 7 | 0.08 | 0.25 | 0.03 | 0.3 | | | 0.20 | | | 0.015 |
| 9 | 0.05 | 0.12 | 0.02 | 0.25 | 3 | 2.5 | | | | 0.015 |
| 11 | 0.08 | 0.18 | 0.03 | 0.2 | | | 0.20 | | | 0.015 |
| 12 | 0.08 | 0.25 | 0.03 | 0.3 | | | | 0.3 | 0.8 | 0.015 |
| 16 | 0.08 | 0.25 | 0.03 | 0.3 | | | 0.05 | | | 0.015 |
| 17 | 0.08 | 0.18 | 0.03 | 0.2 | | | 0.05 | | | 0.015 |
| 18 | 0.05 | 0.15 | 0.03 | 0.25 | 3 | 2.5 | 0.05 | | | 0.015 |

TYPICAL MECHANICAL PROPERTIES*

| Grade | Tensile KSI Min | Yield KSI Min/Max | % Elongation/2" Min |
|---|---|---|---|
| 1 | 35 | 25/45 | 24 |
| 2 | 50 | 40/65 | 20 |
| 3 | 64 | 55/75 | 18 |
| 4 | 80 | 70/95 | 15 |
| 5 | 130 | 120** | 10 |
| 7 | 50 | 40/65 | 20 |
| 9 | 90 | 70** | 15 |
| 11 | 35 | 26/46 | 24 |
| 12 | 70 | 50** | 12 |
| 16 | 50 | 40/85 | 20 |
| 17 | 35 | 25/45 | 24 |
| 18 | 90 | 70** | 15 |

*Mill Annealed Condition
**Minimum

TYPICAL PHYSICAL PROPERTIES

| | Grade 1, 2, 3, 4, 7, 11, 12, 16, 17, 18 | Grade 5 | Grade 9 |
|---|---|---|---|
| Density | 0.163 lb/in$^3$ | 0.160 lb/in$^3$ | 0.162 lb/in$^3$ |
| Modulus | $15 \times 10^8$ psi | $16 \times 10^8$ psi | $15 \times 10^8$ psi |
| Beta Transus (±25° F.) | 1635° F.-1735° F. | 1800° F. | 1715° F. |
| Thermal Conductivity | 13-10 Btu/ft h ° F. | 4 Btu/ft h ° F. | 10 Btu/ft h ° F. |
| Thermal Expansion (32-600° F.) | $5.1 \times 10^{-6}$/° F. | $5.3 \times 10^{-6}$/° F. | $5.5 \times 10^{-6}$/° F. |
| Melt temperature | 3000° F. | 3000° F. | 3000° F. |

CONCLUSIONS

In summary, the Applicant has found that a very pure titanium precursor can be produced in high yield from ilmenite (which is the cheapest source of titanium) and that this precursor can be used to produce titanium metal with oxygen levels which are lower than those of commercial grade 1 titanium. The low oxygen content increases the malleability of the metal. The metal is also protected from oxidation during forging via a metal fluoride based coating. The Applicant believes that the method of the invention will allow titanium to be produced at a cost which is approximately the same as that of high-grade stainless steel. This would greatly increase the world market for titanium.

The invention claimed is:

1. A method of producing titanium metal from a titanium-containing material, the method including the steps of producing a solution of $M^{II}TiF_6$ from the titanium-containing material, selectively precipitating $(NH_4)_2TiF_6$ from the solution by the addition of $(NH_4)aXb$ in which $M^{II}$ is a cation of the type which forms a hexafluorotitanate, the $M^{II}$ being selected from the group consisting of $Fe^{2+}$, $Mn^{2+}$, $Zn^{2+}$, $Mg^{2+}$, $Cu^{2+}$, $Ca^{2+}$, $Sr^{2+}$, $Ba^{2+}$, $Co^{2+}$ and $Ni^{2+}$;

X is an anion selected from halide, sulphate, nitrite, acetate and nitrate; and a and b are 1 or 2; and using the selectively precipitated $(NH_4)_2TiF_6$ to produce titanium.

2. A method as claimed in claim 1, in which the $M^{II}TiF_6$ is $FeTiF_6$ and $(NH_4)aXb$ is selected from $NH_4Cl$ and $(NH_4)_2SO_4$.

3. A method as claimed in claim 1, in which the titanium-containing material is selected from ilmenite, rutile, anatase, perovskite, brookite, pseudo-brookite, sphene, leucoxene and titaniferous slags.

4. A method as claimed in claim 3 in which the $M^{II}TiF_6$ is $FeTiF_6$ and the solution of $FeTiF_6$ is produced by digestion of the titanium-containing material with aqueous HF.

5. A method as claimed in claim 4, in which the concentration of the HF is between about 5 and 60%.

6. A method as claimed in claim 5, in which the concentration of the HF is between about 20 and 24%.

7. A method as claimed in claim 4, which includes the step of adding a reducing agent to the solution produced in the digestion step to reduce at least some of any Fe(III) present in the solution to Fe(II).

8. A method as claimed in claim 1, which includes the further step of purifying the $M^{II}TiF_6$ by recrystallisation.

9. A method as claimed in claim 1, which includes the step of reducing the $(NH_4)_2TiF_6$, in which the titanium is in the oxidation state IV, to produce a titanium-III product, decomposing the titanium-III product to produce $TiF_3$ and reducing the $TiF_3$ to titanium.

10. A method as claimed in claim 9, in which the $(NH_4)_2TiF_6$ is reduced to the Ti(III) product with a reducing agent selected from aluminium, manganese, zinc, iron and magnesium.

11. A method as claimed in claim 9, in which the $(NH_4)_2TiF_6$ is electrolytically reduced to produce the Ti(III) product.

12. A method of recovering titanium from ilmenite, the method including the steps of digesting ilemenite in aqueous HF to produce $FeTiF_6$ and removing insoluble material;

selectively precipitating $(NH_4)_2TiF_6$ by addition of an ammonium salt;

optionally purifying the precipitated $(NH_4)_2TiF_6$;

reducing the optionally purified $(NH_4)_2TiF_6$ to $NH_4TiF_4$ with mercury activated aluminium;

pyrolizing the $NH_4TiF_4$ to produce $TiF_3$;

reducing the $TiF_3$ to titanium metal with aluminium to produce Ti powder and $AlF_3$; and removing the bulk of the $AlF_3$ by sublimation.

13. A method of recovering titanium from a $TiO_2$-containing material, the method including the steps of preparing an aqueous hydrofluoric acid solution containing $M^{II}$, digesting the $TiO_2$-containing material in the solution to produce a solution containing $M^{II}TiF_6$ and removing insoluble material;

selectively precipitating $(NH_4)_2TiF_6$ by addition of an ammonium salt;

optionally purifying the precipitated $(NH_4)_2TiF_6$;

reducing the $(NH_4)_2TiF_6$ to $NH_4TiF_4$ with mercury activated aluminium;

pyrolizing the $NH_4TiF_4$ to produce $TiF_3$; and reducing the $TiF_3$ to titanium metal.

14. A method as claimed in claim 13, in which the $TiO_2$-containing material is selected from anatase, rutile, brookite, leucoxene and titaniferous slag.

15. A method of producing titanium metal from a titanium-containing material, the method including the steps of producing a solution of $M^{II}TiF_6$ from the titanium-containing material, selectively precipitating $(NH_4)_2TiF_6$ from the solution by the addition of $(NH_4)aXb$ in which $M^{II}$ is a cation of the type which forms a hexafluorotitanate, the $M^{II}$ being selected from the group consisting of $Fe^{2+}$, $Mn^{2+}$, $Zn^{2+}$, $Mg^{2+}$, $Cu^{2+}$, $Ca^{2+}$, $Sr^{2+}$, $Ba^{2+}$, $Co^{2+}$; and $Ni^{2+}$; and using the selectively precipitated $(NH_4)_2TiF_6$ to produce titanium, wherein $(NH_4)aXb$ is selected from $NH_4Cl$ and $(NH_4)_2SO_4$.

16. A method as claimed in claim 15, in which the titanium-containing material is selected from ilmenite, rutile, anatase, perovskite, brookite, pseudo-brookite, sphene, leucoxene and titaniferous slags.

17. A method as claimed in claim 16 in which the $M^{II}TiF_6$ is $FeTiF_6$ and the solution of $FeTiF_6$ is produced by the digestion of the titanium-containing material with aqueous HF in a range of between about 5 and 60%.

18. A method as claimed in claim 17, which includes the step of adding a reducing agent to the solution produced in the digestion step to reduce at least some of any Fe(III) present in the solution to Fe(II) or which includes the further step of purifying the $M^{II}TiF_6$ by recrystallisation.

19. A method as claimed in claim 15, which includes the step of reducing the $(NH_4)_2TiF_6$, in which the titanium is in the oxidation state IV, to produce a titanium-III product, decomposing the titanium-III product to produce $TiF_3$ and reducing the $TiF_3$ to titanium.

20. A method as claimed in claim 19, in which the $(NH_4)_2TiF_6$ is reduced to the Ti(III) product with a reducing agent selected from aluminium, manganese, zinc, iron and magnesium or in which the $(NH_4)_2TiF_6$ is electrolytically reduced to produce the Ti(III) product.

* * * * *